US010842277B2

(12) United States Patent
Harden

(10) Patent No.: US 10,842,277 B2
(45) Date of Patent: Nov. 24, 2020

(54) ITEMS OF FURNITURE AND METHODS OF MANUFACTURING, PACKAGING, AND ASSEMBLING THEM

(71) Applicant: Daniel Kendall Harden, Palo Alto, CA (US)

(72) Inventor: Daniel Kendall Harden, Palo Alto, CA (US)

( * ) Notice: Subject to any disclaimer, the term of this patent is extended or adjusted under 35 U.S.C. 154(b) by 5 days.

(21) Appl. No.: 16/032,937

(22) Filed: Jul. 11, 2018

(65) Prior Publication Data

US 2020/0015591 A1 Jan. 16, 2020

(51) Int. Cl.

| | |
|---|---|
| ***A47C 4/03*** | (2006.01) |
| ***A47C 4/02*** | (2006.01) |
| *A47C 5/10* | (2006.01) |

(52) U.S. Cl.

CPC ..... *A47C 4/03* (2013.01); *A47C 4/021* (2013.01); *A47C 4/027* (2013.01); *A47B 2230/0081* (2013.01); *A47C 5/10* (2013.01)

(58) Field of Classification Search

CPC ..... A47C 4/03; A47C 4/021; A47C 4/027; A47C 5/10; A47B 2230/0081

See application file for complete search history.

(56) References Cited

U.S. PATENT DOCUMENTS

| | | | | |
|---|---|---|---|---|
| 2,205,302 A * | 6/1940 | Morgenstern | A47C 31/11 297/228.12 |
| 3,142,514 A | 7/1964 | Ginat | |
| 3,784,254 A * | 1/1974 | Longato | A47C 4/02 297/451.11 |
| 4,146,269 A * | 3/1979 | Beckley | A47C 4/02 108/158 |
| D251,942 S | 5/1979 | VonHeck | |
| D257,457 S | 10/1980 | Nash | |
| D260,334 S | 8/1981 | Horn | |

(Continued)

FOREIGN PATENT DOCUMENTS

| | | |
|---|---|---|
| CN | 203392217 U | 1/2014 |
| CN | 206576601 U | 10/2017 |
| DE | 202018102053 U1 | 4/2018 |

OTHER PUBLICATIONS

International Search Report and Written Opinion from PCT application No. PCT/US 2019/041335 (filed Jul. 11, 2019), dated Oct. 24, 2019.

*Primary Examiner* — Philip F Gabler

(74) *Attorney, Agent, or Firm* — Jacobsen IP Law; Krista S. Jacobsen

(57) ABSTRACT

Disclosed herein are assembled and unassembled items of furniture and methods of fabricating the components of items of furniture, methods of packaging the components of items of furniture, and methods of assembling items of furniture. The disclosed items of furniture have at least two legs and a working portion comprising two overhangs and a top with an upper surface and a lower surface. Some embodiments also include a back portion. Each leg has a lower portion and an upper portion that meet at an interface. The lower portion resides below the lower surface, and the upper portion resides above the lower surface. Each leg extends through the top through a hole that has a perimeter that is smaller than the perimeter of the lower portion at the interface and larger than the perimeter of the upper portion at the interface.

20 Claims, 19 Drawing Sheets

(56) References Cited

U.S. PATENT DOCUMENTS

| | | | | | |
|---|---|---|---|---|---|
| 5,026,121 | A * | 6/1991 | Ratalahti | A47C 4/02 | 297/440.1 |
| D319,545 | S | 9/1991 | Fairbank | | |
| 5,125,348 | A * | 6/1992 | Horwitz | A47B 7/00 | 108/180 |
| 5,288,131 | A * | 2/1994 | Singley | A47C 5/14 | 297/452.24 |
| 5,673,882 | A * | 10/1997 | Huang | A47B 17/00 | 108/158.11 |
| 6,319,585 | B1 * | 11/2001 | Coronado | A47C 5/14 | 428/106 |
| 6,666,518 | B2 * | 12/2003 | Bruschi | A47C 3/04 | 297/239 |
| D499,565 | S | 12/2004 | Portman, Jr. | | |
| 7,429,084 | B2 * | 9/2008 | Diedrich | A47C 4/02 | 297/440.16 |
| 7,510,244 | B1 * | 3/2009 | Shin | A47C 1/12 | 297/451.11 |
| D752,355 | S | 3/2016 | Ballendat | | |
| D764,825 | S | 8/2016 | Grcic | | |
| 9,986,834 | B1 * | 6/2018 | Chen | A47C 7/00 | |
| 2001/0046578 | A1 * | 11/2001 | Frost | A47C 7/002 | 428/58 |

* cited by examiner

ITEMS OF FURNITURE AND METHODS OF MANUFACTURING, PACKAGING, AND ASSEMBLING THEM

CROSS-REFERENCE TO RELATED APPLICATIONS

This application hereby incorporates by reference the contents of U.S. design patent application Ser. No. 29/616,315, entitled "CHAIR" and filed on Sep. 5, 2017.

BACKGROUND

Items of furniture include chairs, sofas, tables, desks, and others. Many items of furniture arrive at their ultimate destinations (e.g., an office, a restaurant, a home, etc.) in fully-assembled form. For this reason, items of furniture tend to be large, awkward, and expensive to ship.

In addition, most items of furniture are complex to assemble because they use large numbers of items of hardware (e.g., fasteners such as bolts, nuts, screws, nails, etc.) to provide the desired levels of sturdiness and durability. For example, the underside of a typical chair includes several bolts, screws, nuts, etc. used to hold together the legs and the seat, and sometimes also the back. Because of the large number of parts involved, furniture assembly processes tend to be time-consuming, expensive, and either too complex or frustrating for end users.

There is, therefore, an ongoing need for new approaches that address these and other shortcomings of existing furniture.

SUMMARY

This summary is not an exhaustive summary of all embodiments.

Disclosed herein are items of furniture, in assembled and unassembled forms, methods of fabricating the components of the items of furniture, methods of assembling the items of furniture, and methods of packaging the components of unassembled items of furniture for shipment.

In some embodiments, an item of furniture comprises a first leg, a second leg, and a working portion. The first leg has a first floor-contacting end, a first upper end, a first lower portion extending between the first floor-contacting end and a first interface between the first floor-contacting end and the first upper end, and a first upper portion extending between the first interface and the first upper end. The first lower portion has a first lower-portion outer perimeter at the first interface, and the first upper portion has a first upper-portion outer perimeter at the first interface, the first upper-portion outer perimeter being smaller than the first lower-portion outer perimeter. Similarly the second leg has a second floor-contacting end, a second upper end, a second lower portion extending between the second floor-contacting end and a second interface between the second floor-contacting end and the second upper end, and a second upper portion extending between the second interface and the second upper end. The second lower portion has a second lower-portion outer perimeter at the second interface, and the second upper portion has a second upper-portion outer perimeter at the second interface, the second upper-portion outer perimeter being smaller than the second lower-portion outer perimeter. The working portion comprises a first overhang, a second overhang, and a top having an upper surface and a lower surface. The top has a first hole and a second hole, each of the first and second holes extending between the lower surface and the upper surface. A perimeter of the first hole at the lower surface is smaller than the first lower-portion outer perimeter and larger than the first upper-portion outer perimeter. The first leg extends through the first hole. The first lower portion contacts the lower surface at the first interface, and the first upper end is coupled to the first overhang. A perimeter of the second hole at the lower surface is smaller than the second lower-portion outer perimeter and larger than the second upper-portion outer perimeter. The second leg extends through the second hole. The second lower portion contacts the lower surface at the second interface, and the second upper end is coupled to the second overhang.

In some embodiments, a method comprises fabricating first and second legs and a working portion for an item of furniture. The first leg has (a) a first floor-contacting end, (b) a first upper end, (c) a first lower portion extending between the first floor-contacting end and a first interface between the first floor-contacting end and the first upper end, the first lower portion having a first lower-portion outer perimeter at the first interface, and (d) a first upper portion extending between the first interface and the first upper end, the first upper portion having a first upper-portion outer perimeter at the first interface, the first upper-portion outer perimeter being smaller than the first lower-portion outer perimeter. The second leg has (i) a second floor-contacting end, (ii) a second upper end, (iii) a second lower portion extending between the second floor-contacting end and a second interface between the second floor-contacting end and the second upper end, the second lower portion having a second lower-portion outer perimeter at the second interface, and (iv) a second upper portion extending between the second interface and the second upper end, the second upper portion having a second upper-portion outer perimeter at the second interface, the second upper-portion outer perimeter being smaller than the second lower-portion outer perimeter. The working portion has a top, a first overhang, and a second overhang. The top comprises an upper surface, a lower surface, and at least two holes, each of the at least two holes extending between the lower surface and the upper surface. A perimeter of a first hole of the at least two holes is smaller than the first lower-portion outer perimeter and larger than the first upper-portion outer perimeter, and a perimeter of a second hole of the at least two holes is smaller than the second lower-portion outer perimeter and larger than the second upper-portion outer perimeter.

In some embodiments, the method further comprises inserting, from a direction from the lower surface to the upper surface, the first upper portion through the first hole, fastening the first upper end to the first overhang, inserting, from the direction from the lower surface to the upper surface, the second upper portion through the second hole, and fastening the second upper end to the second overhang.

In some embodiments, an unassembled item of furniture comprises a first leg, a second leg, and a working portion. The first leg has a first floor-contacting end, a first upper end, a first lower portion extending between the first floor-contacting end and a first interface between the first floor-contacting end and the first upper end, and a first upper portion extending between the first interface and the first upper end. The first lower portion has a first lower-portion outer perimeter at the first interface, and the first upper portion has a first upper-portion outer perimeter at the first interface, the first upper-portion outer perimeter being smaller than the first lower-portion outer perimeter. The second leg has a second floor-contacting end, a second upper end, a second lower portion extending between the second floor-contacting end and a second interface between the second floor-contacting end and the second upper end, and a second upper portion extending between the second interface and the second upper end. The second lower portion has a second lower-portion outer perimeter at the second interface, and the second upper portion has a second upper-portion outer perimeter at the second interface, the second upper-portion outer perimeter being smaller than the second lower-portion outer perimeter. The working portion has a first overhang, a second overhang, and a top having an upper surface and a lower surface. The top comprises a first hole and a second hole, each of the first and second holes extending between the lower surface and the upper surface. A perimeter of the first hole is smaller than the first lower-portion outer perimeter and larger than the first upper-portion outer perimeter, and a perimeter of the second hole is smaller than the second lower-portion outer perimeter and larger than the second upper-portion outer perimeter.

Some embodiments are methods of packaging an unassembled item of furniture, where the unassembled item of furniture comprises a working portion, a back portion, a first leg, and a second leg. In some embodiments, a method comprises (a) placing the back portion in a packaging insert, an outer portion of the packaging insert having a shape configured to fit snugly within an interior of the working portion, (b) placing the first leg in the packaging insert, (c) placing the second leg in the packaging insert, and (d) placing the packaging insert within the interior of the working portion. After completing steps (a), (b), and (c), neither the first leg nor the second leg touches the back portion, and after completing steps (a), (b), (c), and (d), neither the back portion nor the first or second leg touches the working portion.

In some embodiments, a method comprises placing a first end of the working portion into a first packaging insert, placing a first end of the back portion into the first packaging insert, placing a first end of the first leg into the first packaging insert, placing a first end of the second leg into the first packaging insert, placing a second end of the working portion into a second packaging insert, placing a second end of the back portion into the second packaging insert, placing a second end of the first leg into the second packaging insert, and placing a second end of the second leg into the second packaging insert.

In some embodiments, a packaged, unassembled item of furniture comprises a working portion, a back portion, a first leg, a second leg, and a packaging insert having at least one slot and at least two holes. The back portion extends through the slot of the packaging insert, the first leg extends through a first one of the at least two holes of the packaging insert, and the second leg extends through a second hole of the at least two holes of the packaging insert. The packaging insert is positioned within an interior space of the working portion. The first leg is not in contact with the second leg. Neither the first leg nor the second leg is in contact with the back portion, and neither the back portion nor the first leg nor the second leg is in contact with the working portion.

In some embodiments, a packaged, unassembled item of furniture comprises a working portion, a back portion, a first leg, a second leg, and first and second packaging inserts. The working portion has first and second edges, one of the first and second edges of the working portion being a front edge of the working portion, and the other of the first and second edges of the working portion being a rear edge of the working portion. The back portion has first and second edges, one of the first and second edges of the back portion being a lower edge of the back portion, and the other of the first and second edges of the back portion being and an upper edge of the back portion. The first leg has first and second ends, one of the first and second ends of the first leg being a floor-contacting end of the first leg, and the other of the first and second ends of the first leg being an upper end of the first leg. The second leg has first and second ends, one of the first and second ends of the second leg being a floor-contacting end of the second leg, and the other of the first and second ends of the second leg being an upper end of the first leg. The first packaging insert has at least a first slot, a second slot, a first hole, and a second hole. The second slot is enclosed by the first slot, and the first and second holes are enclosed by the first slot. The second packaging insert has at least a third slot, a fourth slot, a third hole, and a fourth hole. The fourth slot is enclosed by the third slot, and the third and fourth holes are enclosed by the third slot. The first edge of the working portion is situated in the first slot, the first edge of the back portion is situated in the second slot, the first end of the first leg is situated in the first hole, and the first end of the second leg is situated in the second hole. The second edge of the working portion is situated in the third slot, the second edge of the back portion is situated in the fourth slot, the second end of the first leg is situated in the third hole, and the second end of the second leg is situated in the fourth hole.

BRIEF DESCRIPTION OF THE DRAWINGS

Objects, features, and advantages of the disclosure will be readily apparent from the following description of certain embodiments taken in conjunction with the accompanying drawings in which.

DETAILED DESCRIPTION

The exemplary item of furniture shown in many of the figures herein (e.g., FIGS. 1A-1C) is a chair. It is to be understood that other items of furniture (e.g., tables, desks, sofas, etc.) may also advantageously include or use the structures, configurations, and methods set forth herein. Items of furniture other than chairs are specifically contemplated.

Figure 1A:
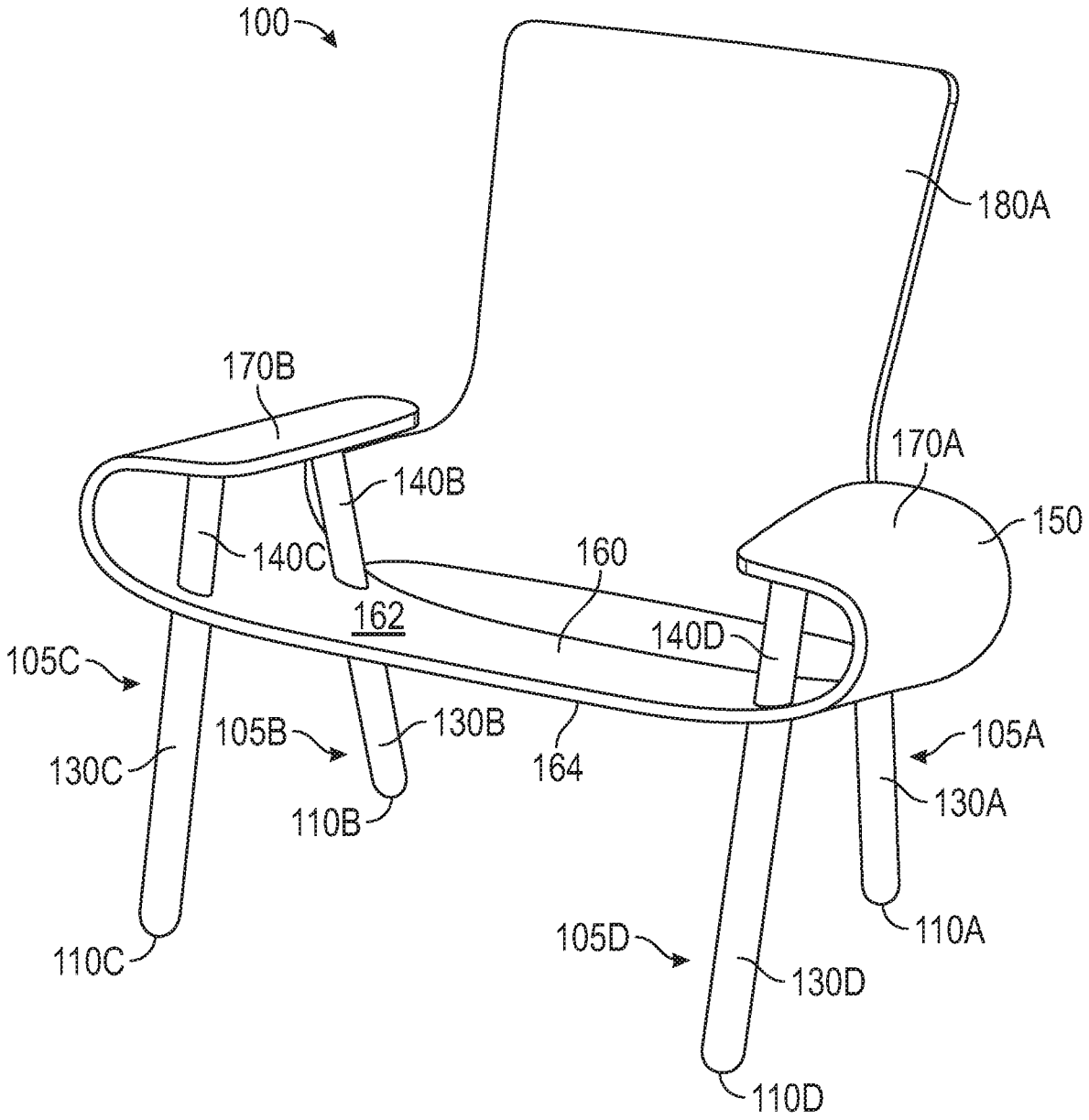
FIG. 1A illustrates an assembled item of furniture in accordance with some embodiments.
Figure 1B:
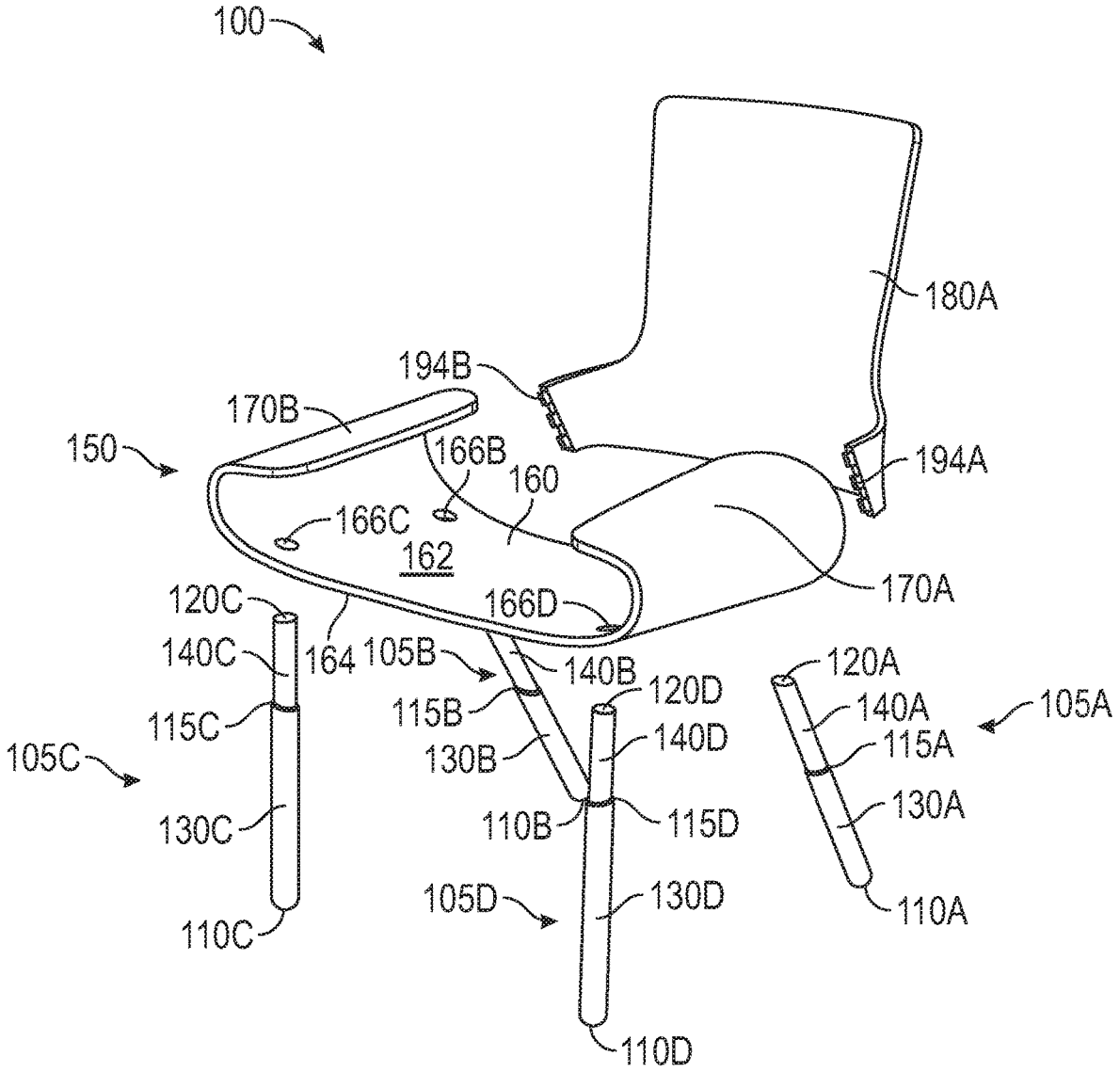
FIG. 1B is an exploded front view of the exemplary item of furniture shown in FIG. 1A.
Figure 1C:
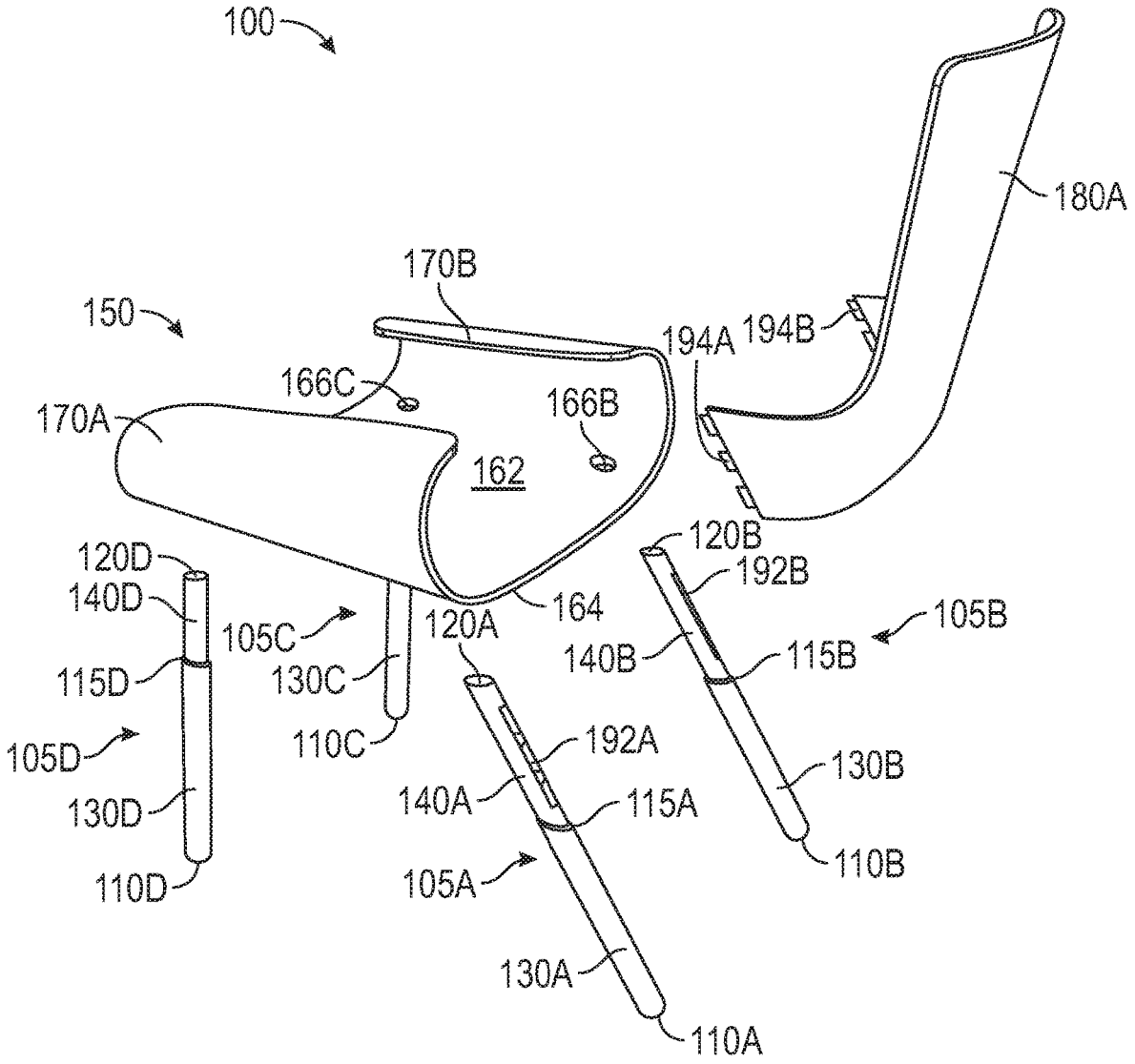
FIG. 1C is an exploded rear view of the exemplary item of furniture shown in FIG. 1A.

FIG. 1A illustrates an assembled item of furniture, namely a chair 100, in accordance with some embodiments. FIG. 1B is an exploded front view of the exemplary chair 100 shown in FIG. 1A, and FIG. 1C is an exploded rear view. The exemplary chair 100 illustrated in FIGS. 1A-1C has four legs 105A, 105B, 105C, and 105D, a working portion 150, and an optional back portion 180A.

The legs 105 are now described with reference to FIGS. 1A-1C and FIGS. 2A-2D, which illustrate the legs 105C and 105A in more detail. The leg 105D is a mirror image of the leg 105C, and the leg 105B is a mirror image of the leg 105A in the chair 100 shown in FIGS. 1A-1C, and therefore the explanations of FIGS. 2A and 2B (leg 105C) apply as well to the leg 105D, and the explanations of FIGS. 2C and 2D (leg 105A) apply as well to the leg 105B.

Each of the legs 105A, 105B, 105C, and 105D has a floor-contacting end 110 (labeled, respectively, 110A through 110D) and an upper end 120 (labeled, respectively, 120A through 120D). Each of the legs 105 also has a lower portion 130 (labeled, respectively, 130A through 130D) and an upper portion 140 (labeled, respectively, 140A through 140D). The lower portion 130 intersects the upper portion 140 at an interface 115 (labeled, respectively, 115A through 115D). The lower portion 130 of each leg 105 extends between the floor-contacting end 110 and a respective interface 115, and the upper portion 140 extends between the interface 115 and the upper end 120. When the chair 100 (or other item of furniture) is assembled and positioned so that the floor-contacting end 110 of each leg 105 is in contact with the floor, the lower portion 130 of each leg 105 resides below the working portion 150 (i.e., the lower portion 130 extends between the floor and the lower surface 164 of the top 160), and the upper portion 140 resides above the lower portion 130 (i.e., the upper portion 140 of each leg 105 extends between the lower surface 164 of the top 160 and its attachment point to one of the overhangs 170). Each leg 105 may be a unitary piece (i.e., an undivided, whole piece), or it may comprise multiple components that are assembled together to make the leg 105.

Figure 8:
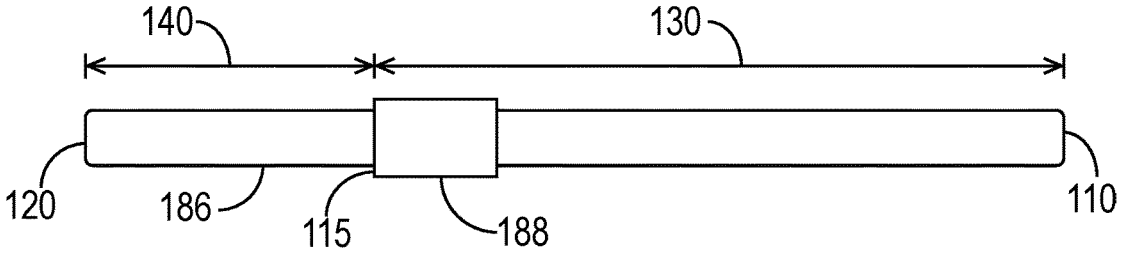
FIG. 8 illustrates a leg of an item of furniture in accordance with some embodiments.

As illustrated by the exemplary legs 105C and 105A shown in FIGS. 2A-2D, the interface 115 may result from an abrupt transition between the lower portion 130 and the upper portion 140. For example, in the examples of FIGS. 1A-1C and 2A-2D, near the interfaces 115, the legs 105, which happen to be cylindrical, have an appearance of stacked oblique cylinders, with the lower portion 130 having a larger radius than the upper portion 140. When a leg 105 comprises multiple components, the interface 115 may be created by a component attached to the outside of an elongated piece. For example, in some embodiments (e.g., as shown in FIG. 8, discussed below), a leg 105 comprises a metal rod (e.g., a cylindrical rod) and a washer, which may have any suitable shape (e.g., cylindrical, hexagonal, etc.). The metal rod may be inserted through and welded to the washer, and a face of the washer creates the interface 115.

Figure 2B:
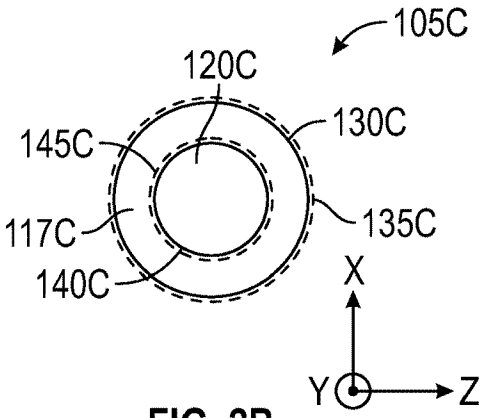
FIGS. 2A and 2B illustrate one of the legs of the exemplary item of furniture shown in FIGS. 1A-1C.
Figure 2A:
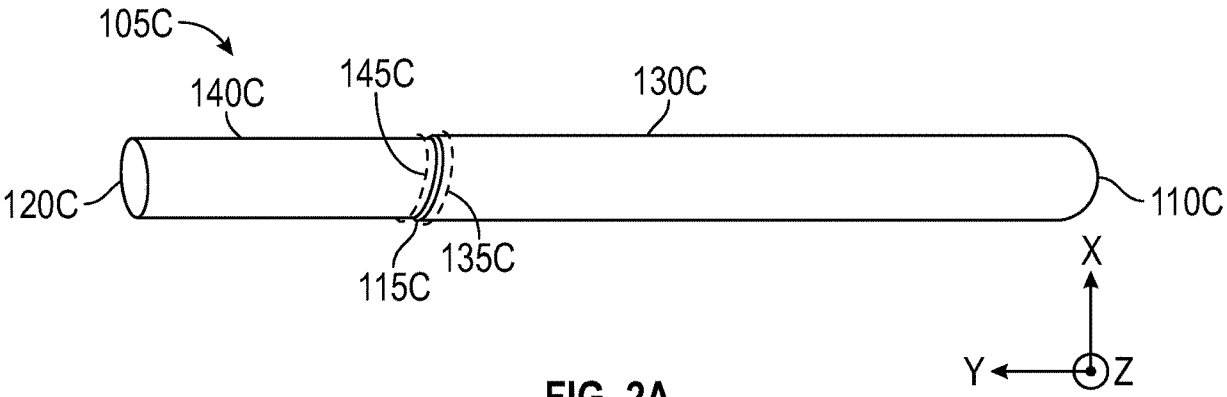
Figure 2D:
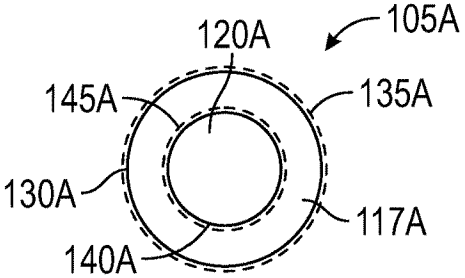
FIGS. 2C and 2D illustrate another of the legs of the exemplary item of furniture shown in FIGS. 1A-1C.
Figure 2C:
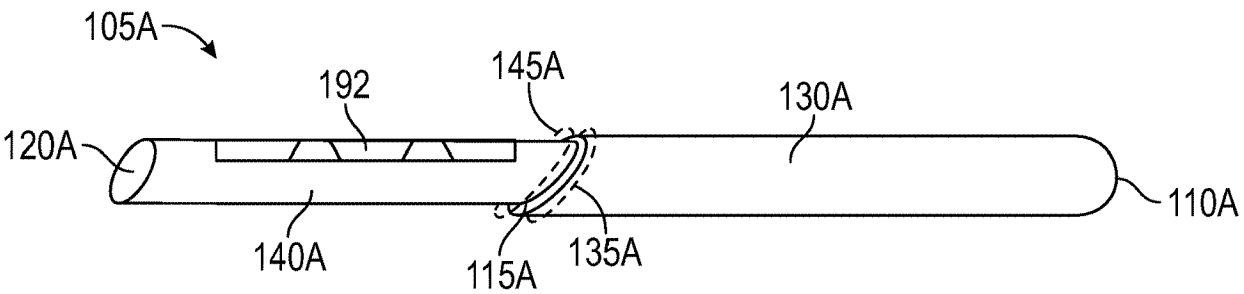

FIGS. 2B and 2D show, respectively, the legs 105C and 105A viewed from the upper ends 120C and 120A with the differences in the outer perimeters exaggerated to illustrate the identified elements more clearly. In the exemplary embodiment illustrated in FIGS. 1A-1C and 2A-2D, the lower portion 130 has an interface surface 117 at the interface 115 (see FIGS. 2B and 2D). At least a portion of the interface surface 117 of the lower portion 130 contacts the lower surface 164 of the top 160 when the chair 100 is in its assembled form.

For reference, FIGS. 2A and 2B show x-, y-, and z-axes. In the exemplary embodiment illustrated, the interface surface 117 is planar and lies in an arbitrary plane (i.e., the orientation of the plane of the interface surface 117 is not necessarily parallel to or in any particular plane, such as, for example, the x-z plane). If the lower surface 164 is substantially flat near a hole 166 in the top 160 (described below), the entire interface surface 117 of each of the legs 105 shown in FIGS. 2A-2D may be in contact with the lower surface 164 when the chair 100 is in assembled form.

It is to be understood that the interface surface 117 need not be planar as shown in FIGS. 2A-2D. For example, if the lower surface 164 has a curvature in the immediate vicinity of a hole 166 in the top 160 (described below), the interface surface 117 may follow the curvature of the lower surface 164 so that the entirety of the interface surface 117 is in contact with the lower surface 164 when the chair 100 is in assembled form. Alternatively, in some embodiments, only a portion of the interface surface 117 is in contact with the lower surface 164 when the chair 100 is in assembled form.

As shown in FIGS. 2B and 2D, the lower portion 130 of each leg 105 has a lower-portion outer perimeter 135 at the interface 115, and the upper portion 140 of each leg 105 has an upper-portion outer perimeter 145 at the interface 115. The lower-portion outer perimeter 135 at the interface 115 is the perimeter of the interface surface 117. The upper-portion outer perimeter 145 at the interface 115 is the perimeter of the upper portion 140 at its closest proximity to the interface surface 117. Like the interface surface 117, the lower-portion outer perimeter 135 and upper-portion outer perimeter 145 may lie in a plane, or they may be non-planar; if planar, the lower-portion outer perimeter 135 and/or the upper-portion outer perimeter 145 may lie in any arbitrary plane defined by the axes illustrated in FIGS. 2A and 2B (i.e., a perimeter need not lie in a the x-z plane or a plane parallel to the x-z plane).

The upper-portion outer perimeter 145 of a selected leg 105 is smaller than the lower-portion outer perimeter 135 of that leg 105 and smaller than the perimeter 168 of the corresponding hole 166 in the working portion 150 (discussed below). As a result, when that leg 105 is inserted through the corresponding hole 166 in the working portion 150, in the direction from the lower surface 164 toward the upper surface 162, the upper portion 140 fits through the hole 166, but the lower portion 130 does not.

FIGS. 1A-1C and FIGS. 2A-2D illustrate legs 105 having cylindrical lower and upper portions 130, 140 with circular cross-sections. Legs 105 such as those illustrated herein may be fabricated in various ways. For example, if the legs 105 are cylindrical and comprise wood, they may be fabricated (either as unitary pieces or in parts that are then connected together) by machining a piece of wood. As a specific example, the legs 105 may be fabricated by rotating a piece of wood about an axis (e.g., using a lathe) and, while the wood is rotating, removing a portion of the piece of wood (e.g., using a tool to cut, sand, knurl, drill, deform, etc.). Unitary legs 105 may be fabricated by removing more wood from the upper portion 140 than from the lower portion 130.

It is to be appreciated that the lower portions 130 and upper portions 140 may have different shapes than those illustrated herein. For example, the lower and upper portions 130, 140 may be cylindrical with elliptical cross-sections. As another example, the lower portions 130 and upper portions 140 may be cuboid. In general, the lower and upper portions 130, 140 may have any desired shapes.

Moreover, although FIGS. 1A-1C and FIGS. 2A-2D illustrate legs 105 in which the lower portions 130 and the upper portions 140 have substantially uniform perimeters along their lengths (e.g., a cross-section of the lower portion 130 taken parallel to the plane of the interface 115 at most locations along the length of the lower portion 130 will look approximately the same as the cross-section at the interface 115, and a cross-section of the upper portion 140 at most locations along the length of the upper portion 140 taken parallel to the plane of the interface 115 will look approximately the same as the cross-section at the interface 115), the legs 105 are not required to have uniform shapes along their lower and upper portions 130, 140. For example, the lower portion 130 of a leg 105 may be wider or narrower near the floor-contacting end 110 than at the interface 115. Likewise, the upper portion 140 of a leg 105 may be wider or narrower near the upper end 120 than at the interface 115, as long as the upper portion 140 has dimensions that allow it to be inserted through the corresponding hole 166 in the top 160 in the direction from the lower surface 164 to the upper surface 162. For example, one or both of the lower portion 130 or the upper portion 140 may be tapered.

Furthermore, the shape of the lower portion 130 need not be similar to (in the geometry sense) the shape of the upper portion 140. As just one example, the lower portion 130 may be cuboid and the upper portion 140 cylindrical, or vice versa. As another example, the lower portion 130 may have a shape with a uniform cross-section along its length (e.g., cylindrical), and the upper portion 140 may have a shape with a non-uniform cross-section along its length (e.g., conical, pyramidal, etc.), or vice versa. In addition, different legs 105 need not have similarly shaped upper portions 140 or similarly shaped lower portions 130. Restrictions on the leg 105 configurations are set forth below in the discussion of the working portion 150.

It is also to be appreciated that although FIGS. 1A-1C illustrate a chair 100 with four legs 105, the chair 100 may have fewer or more than four legs 105. For example, a chair 100 may include only two legs 105, where, to provide stability, each leg 105 spans a larger surface area of the floor than the legs 105A-105D shown in FIGS. 1A-1C. As a specific example, in embodiments having only two legs 105, each of the two legs 105 may have an elongated, more rectangular cross-section in the plane of the working portion 150, and the corresponding two holes 166 in the working portion 150 may be correspondingly elongated. As another example, in embodiments having only two legs 105, the portions of the legs 105 below the first and second locations 115A, 115B may broaden as the legs 105 extend to the floor so that the legs 105 provide a desired level of stability.

In some embodiments in which the chair 100 includes a back portion 180 (discussed below), at least one leg 105 includes a feature to facilitate attachment of the back portion 180 to the leg 105. For example, the back portion 180 may be attached to the at least one leg 105 by a mortise and tenon joint. As will be appreciated by persons having ordinary skill in the art, a mortise and tenon joint is a type of joint that connects two pieces of wood or other material using a tenon tongue formed on one end of a first member and a mortise hole cut into a second member. The tenon tongue is cut to fit the mortise hole precisely and may include shoulders that seat when the joint fully enters the mortise hole. The joint may be glued, pinned, or wedged to lock it in place.

In some embodiments that include a back portion 180 attached to at least one leg 105 using a mortise and tenon joint, the at least one leg 105 may include at least one mortise hole 192 (e.g., created during the fabrication process). In the exemplary embodiment illustrated in FIGS. 1A-1C, the leg 105A includes the mortise hole 192A, and the leg 105B includes the mortise hole 192B. The back portion 180A includes corresponding tenon tongues 194A, 194B, discussed further below in the discussion of the back portion 180A.

Figure 6:
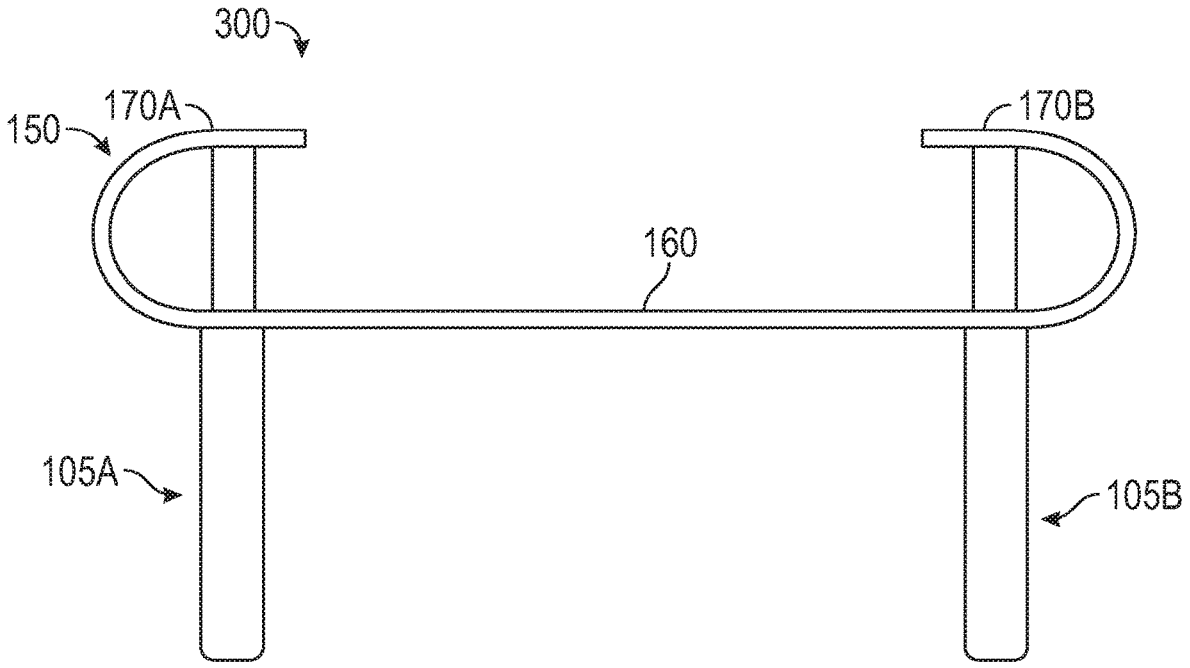
FIG. 6 illustrates an assembled item of furniture in accordance with some embodiments.

It is to be understood that although the legs 105 are described herein in reference to an exemplary chair 100, the legs 105 may be included in other types of furniture, such as, for example, a table or desk as discussed below in the context of the exemplary embodiment shown in FIG. 6.

The working portion 150 is now described with reference to FIGS. 1A-1C and FIGS. 3A and 3B. The working portion 150 has a first overhang 170A, a second overhang 170B, and a top 160, which has an upper surface 162 and a lower surface 164. In some embodiments in which the item of furniture is a chair 100, such as shown in FIGS. 1A-1C, the top 160 is where a person sits, and the overhangs 170A, 170B may serve as armrests. In embodiments in which the item of furniture is another type of furniture, the top 160 may serve a different purpose. For example, when the item of furniture is a desk or table (as illustrated in FIG. 6, discussed below), the top 160 may be a working surface.

The top 160 may have any shape suitable for its intended purpose. For example, when the item of furniture is a chair 100, such as shown in the exemplary embodiment of FIGS. 1A-1C, the upper surface 162 of the top 160 may have a curvature to encourage a particular seating position or to provide a comfortable experience for a person seated in the chair 100. In contrast, when the item of furniture is a desk or table (e.g., FIG. 6, discussed below), the upper surface 162 of the top 160 may be partially or completely flat.

The working portion 150 is shown in the exemplary embodiment of FIGS. 1A-1C and FIGS. 3A and 3B as a unitary piece (i.e., the top 160 and the overhangs 170A, 170B are inseparable). In some embodiments, such as shown in FIGS. 1A-1C, 3A, and 3B, when viewed from the front of the chair 100 (or other item of furniture), the working portion 150 has a shape similar to a rotated version of the letter "C" (i.e., it has a "C-shape"). In some embodiments, the top 160 and the overhangs 170A, 170B are separate pieces that are coupled together (i.e., joined directly or through one or more intervening components). Consequently, the working portion 150 may have a different shape than shown in FIGS. 1A-1C, 3A, and 3B, such as a more rectangular shape when viewed from the front of the chair 100 (or other item of furniture).

Figure 3A:
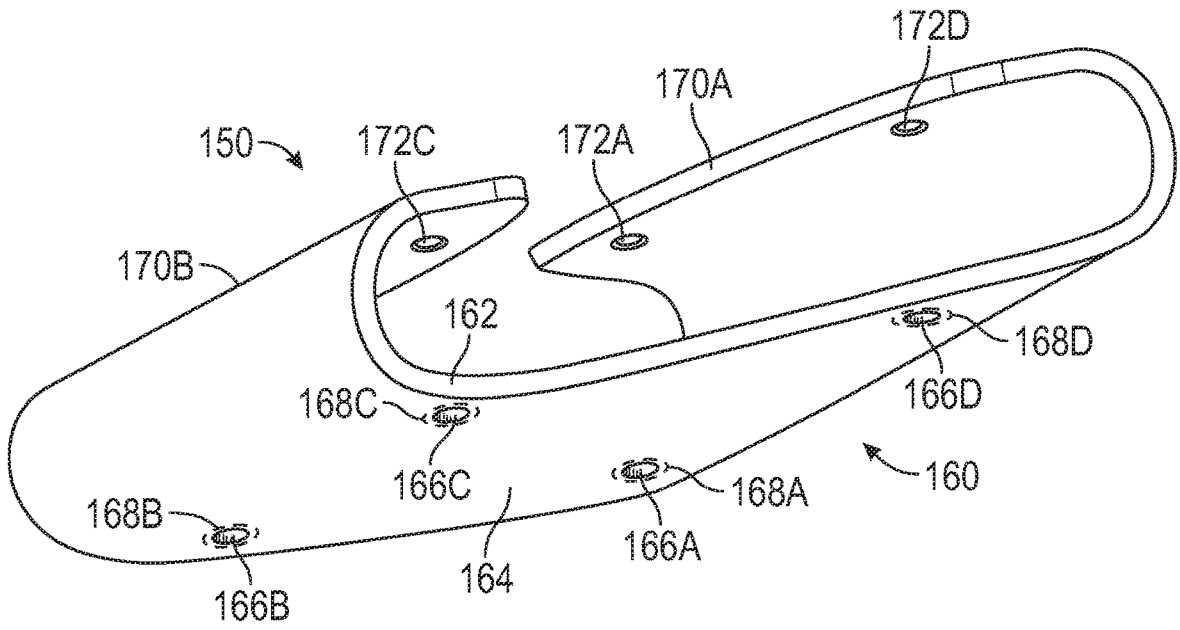
FIGS. 3A and 3B illustrate the working portion of the exemplary item of furniture shown in FIGS. 1A-1C.
Figure 3B:
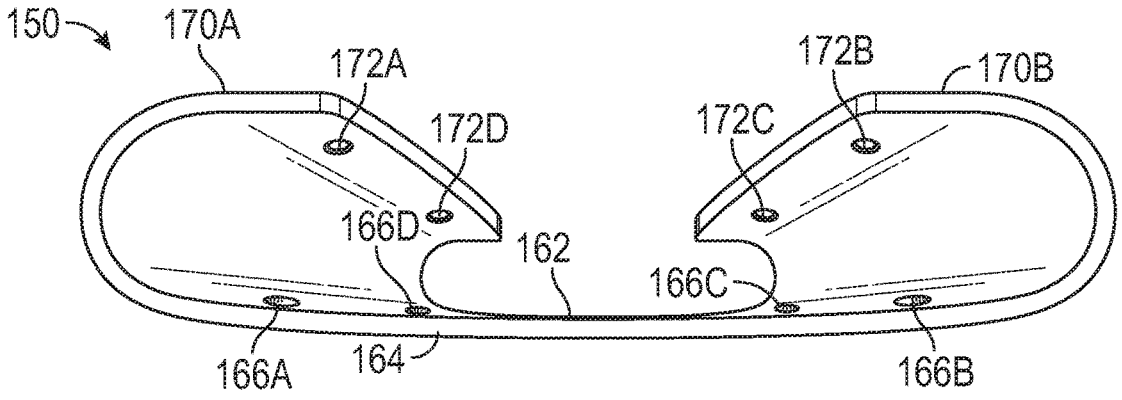

In the exemplary embodiment of FIGS. 1A-1C, 3A, and 3B, the working portion 150 has, in the top 160, a number of holes 166 equal to the number of legs 105. Each hole 166 extends through the top 160 between the lower surface 164 of the top 160 and the upper surface 162 of the top 160. In the exemplary chair 100 shown in FIGS. 1A-1C, the top 160 includes four holes 166A-166D for the four legs 105A-105D. FIGS. 3A and 3B illustrate the working portion 150 alone. The holes 166 are: 166A, through which the top portion 140A of the leg 105A extends; 166B, through which the top portion 140B of the leg 105B extends; 166C, through which the top portion 140C of the leg 105C extends; and 166D, through which the top portion 140D of the leg 105D extends.

Because the top 160 has a thickness, the holes 166 are three-dimensional negative spaces. Each hole 166 has a perimeter 168 at the lower surface 164. The perimeter 168 of each hole 166 is larger than the upper-portion outer perimeter 145 of the corresponding leg 105 and smaller than the lower-portion outer perimeter 135 of the corresponding leg 105. As a result, when the leg 105 is inserted into the hole 166 in the direction from the lower surface 164 to the upper surface 162, the upper portion 140 of the corresponding leg 105 can fit through the hole 166, whereas the lower portion 130 cannot.

Each hole 166 and the upper and lower portions 140, 130 of the respective leg 105 may have any shape and orientation that enable the upper portions 140 of the legs 105 to pass through the holes 166 and prevent the lower portions 130 from passing through. In some embodiments, the upper-portion outer perimeter 145 is slightly smaller than the perimeter of the hole 166 so that the upper portion 140 of the leg 105 at the interface 115 substantially fills the hole 166. In some embodiments, the size and shape of the upper portion 140 near the interface 115 are selected so that part of the upper portion 140 in the hole 166 substantially fills the hole 166. In some embodiments, the dimensions of the hole 166 (i.e., its three-dimensional shape) substantially prevent the upper portion 140 from moving relative to the hole 166 when the chair 100 is in its assembled form.

Depending on the angles of the long axes of the legs 105 with respect to the top 160 in an assembled item of furniture, the interior walls of the holes 166 may or may not be perpendicular to the upper and lower surfaces 162, 164 of the top 160. For example, as shown in the exemplary chair 100 of FIGS. 1A-1C, the lower portions 130 and upper portions 140 of the legs 105 are cylindrical, and the legs 105 are not at right angles to the floor. Consequently, each hole 166 has the shape of an oblique cylinder (i.e., a cylinder with a lateral (side) surface that is not perpendicular to the lower or upper surface 164, 162 of the top 160) and a size that is slightly larger than the volume of the upper portion 140 of the leg 105 near the interface 115. It is to be understood that the term "cylindrical" refers not only to right cylinders (i.e., cylinders in which the sides are perpendicular to the planes containing the bases), but also to oblique cylinders (i.e., cylinders in which the sides are not perpendicular to the planes containing the bases), where the bases may be circular or elliptical.

Although FIGS. 1A-1C and FIGS. 2A-2D illustrate legs 105 having cylindrical lower and upper portions 130, 140, and FIGS. 3A and 3B illustrate a top 160 having correspondingly (oblique) cylindrical holes 166, the shapes of the holes 166 need not be identical to the shapes of the upper portions 140 near the interfaces 115. Moreover, as explained previously, the lower portions 130 and upper portions 140 may have different shapes altogether. As just one example, the lower portions 130 may be cuboid and the upper portions 140 cylindrical, or vice versa. In general, the lower portions 130 and the upper portions 140 may have any suitable shapes, as long as (a) the lower-portion outer perimeter 135 is greater than the perimeter 168 of the hole 166 at the lower surface 164 of the top 160, (b) the upper-portion outer perimeter 145 is less than the perimeter of the hole 166 at the lower surface 164 of the top 160, and (c) the upper portion 140 can pass through the hole 166 when the chair 100 is assembled.

In some embodiments, at least one overhang 170 of the working portion 150 includes a negative space 172 into which the upper end 120 of a leg 105 fits when the item of furniture (e.g., the chair 100 shown in FIGS. 1A-1C) is in assembled form. FIGS. 3A and 3B illustrate the negative spaces 172A and 172D in the overhang 170A, into which the upper ends 120A and 120D of the legs 105A and 105B extend when the item of furniture is assembled, and FIGS. 3A and 3B illustrate the negative spaces 172B and 172C in the overhang 170B, into which the upper ends 120B and 120C of the legs 105B and 105C extend when the item of furniture is assembled. If present, a negative space 172 may include a feature to facilitate the attachment of a leg 105. For example, the negative space 172 may be a threaded hole, and the upper portion 140 of the leg 105 may include a thread near the upper end 120 so that, after having been inserted through a hole 166, the leg 105 may be secured into place by twisting the leg 105 to mate the thread near the upper end 120 to the threaded hole. As another example, the negative space 172 may include one portion of an attachment mechanism, and the (not-necessarily-cylindrical) leg 105 may include the corresponding portion of the attachment mechanism. The attachment mechanism may be any mechanism that secures the leg 105 to the overhang 170. Exemplary attachment mechanisms include, but are not limited to, mortise and tenon, a dowel joint, a dovetail joint, etc. Securing the leg 105 into place into a negative space 172 may be accomplished, for example, by turning the leg 105 and/or by applying pressure along the length of the leg 105.

In addition or alternatively, a leg 105 may be secured to an overhang 170A, 170B, with or without a negative space 172, by adhesive and/or hardware (e.g., a screw, a bolt, a dowel, etc.). FIGS. 3C through 3F illustrate several exemplary ways in which the legs 105 may be secured to the overhangs 170A, 170B. FIG. 3C illustrates the overhang 170B with a shim 175 (e.g., a thin strip of material, which may be the same material as the rest of the overhang 170B or a different material) attached to and protruding from the underside of the overhang 170B. (Alternatively, the shim 175 may be an integral part of the overhang 170B, e.g., if the working portion 150 is made using a mold.) The upper portion of FIG. 3C is a view of the top of the overhang 170B over the leg 105C, and the lower portion of FIG. 3C is a is a "slice" of an item of furniture through the leg 105C, the shim 175, and the overhang 170B (and part of the rest of the working portion 150). The dashed lines in the upper portion of FIG. 3C indicate the location of the shim 175, which is not visible in the top view, on the underside of the overhang 170B. The shim 175 includes a negative space 172 into which the upper end 120C of the leg 105C fits. The upper end 120C of the leg 105C may fixed within the negative space 172 by, for example, adhesive. As another example, the area near the upper end 120C of the leg 105C may include a male thread, and the negative space 172 may be a threaded hole.

FIG. 3C illustrates only the portion of the overhang 170B near the leg 105C. The leg 105B may be attached similarly to the overhang 170B, either by the same shim 175 (in which case the shim 175 extends as shown in FIG. 3C) or by a second shim 175 located in a suitable location on the underside of the overhang 170B. Likewise, the legs 105A and 105D may be attached similarly to the overhang 170A if the overhang 170A includes a shim 175.

Figure 3D:
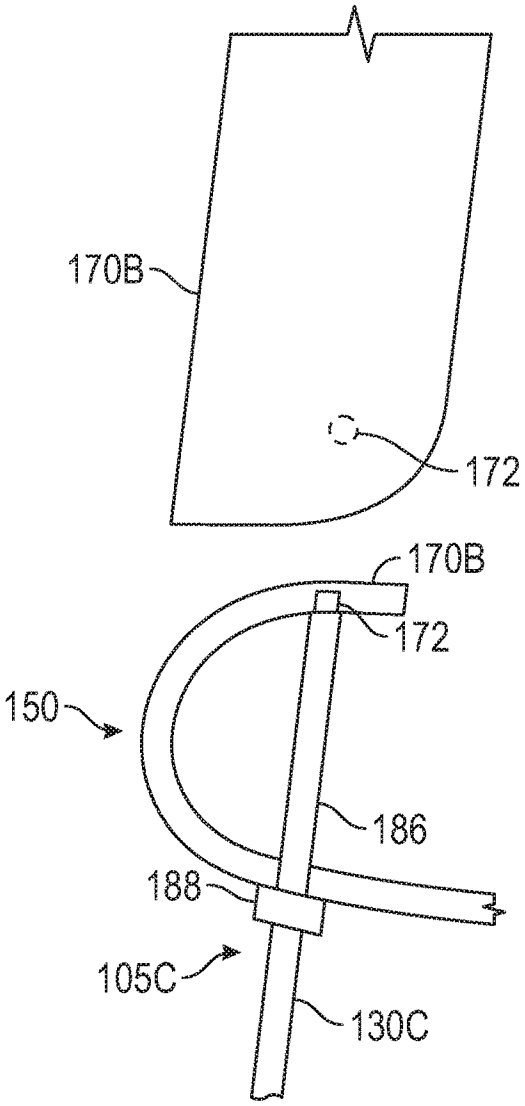
FIGS. 3C-3F illustrate how the legs of an item of furniture may be attached to the working portion in accordance with some embodiments.
Figure 3C:
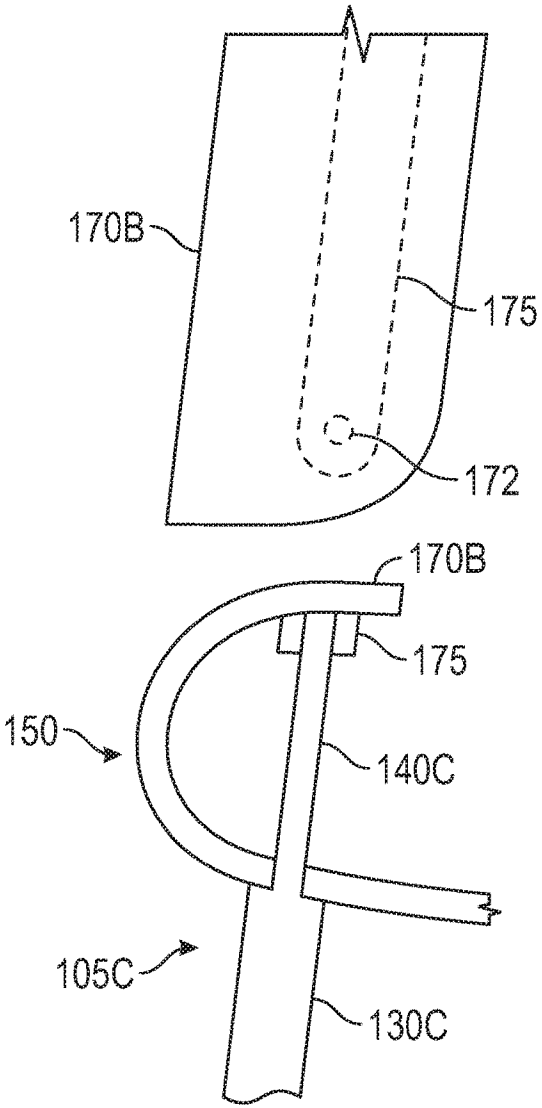

FIG. 3D illustrates the overhang 170B with a negative space 172 into which the upper end 120C of the leg 105C fits. In the exemplary embodiment of FIG. 3D, the leg 105C comprises a rod 186 and a washer 188, which are discussed in more detail in the context of FIG. 8 below. The leg 105C may alternatively be another style of leg 105, such as a unitary piece. In FIG. 3D, the overhang 170B itself includes the negative space 172. The upper end 120C of the leg 105C may fixed within the negative space 172 by, for example, a threading mechanism. For example, the area near the upper end 120C of the leg 105C may include a male (or female) thread, and the negative space 172 may include a corresponding female (or male) threaded hole. As indicated by the dashed lines in the upper portion of FIG. 3D, the upper end 120C of the leg 105C is not visible in the overhead view of the overhang 170B.

Figure 3F:
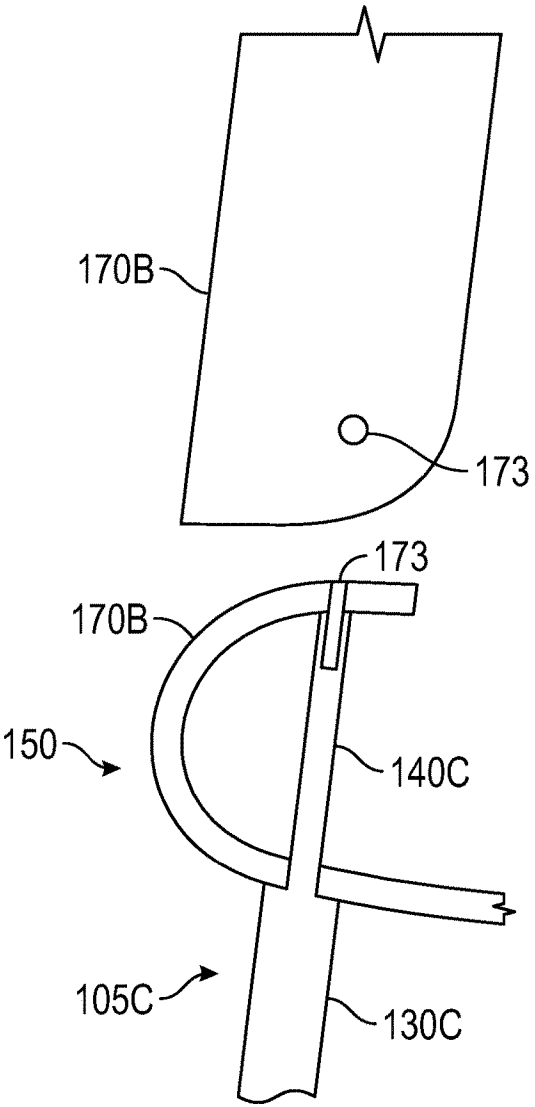
Figure 3E:
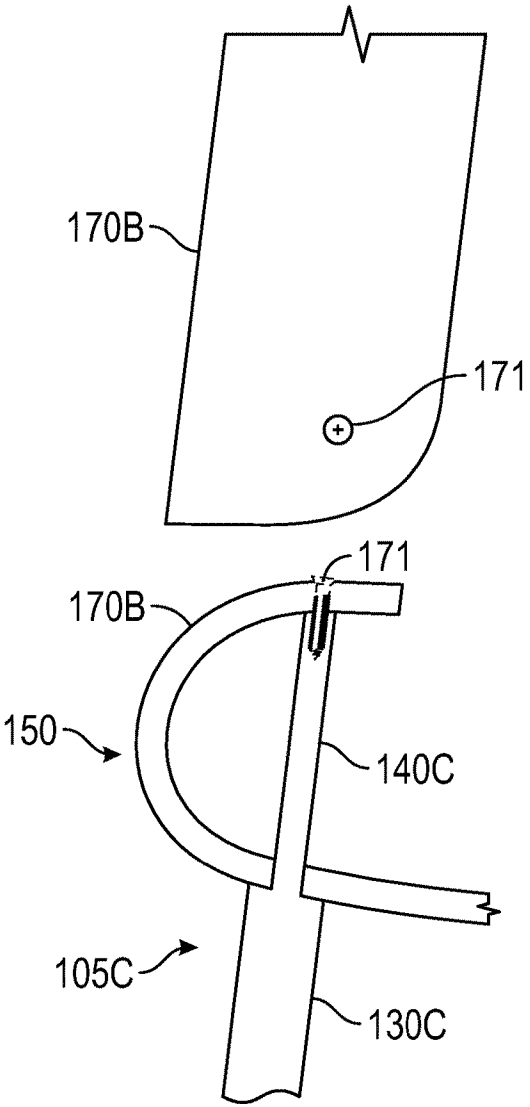

In the embodiments of FIGS. 3C and 3D, the mechanism attaching the leg 105C to the overhang 170B is not apparent in the overhead view of the overhang 170B. FIGS. 3E and 3F illustrate other exemplary attachment mechanisms that are visible in the overhead view of the overhang 170B. FIG. 3E illustrates the leg 105C attached to the overhang 170B by a screw 171 inserted through the top of the overhang 170B in accordance with some embodiments. In the exemplary embodiment of FIG. 3E, the upper portion 140C of the leg 105C includes a hole at the upper end 120C into which the screw 171 fits to secure the leg 105C to the overhang 170B. As shown in the upper portion of FIG. 3E, the head of the screw 171 is visible in the overhead view of the overhang 170B. It is to be understood that the head of the screw 171 may alternatively be covered or obscured.

FIG. 3F illustrates the leg 105C attached to the overhang 170B by a dowel or peg 173 inserted through the top of the overhang 170B in accordance with some embodiments. In the exemplary embodiment of FIG. 3F, the upper portion 140C of the leg 105C includes a hole at the upper end 120C into which the dowel or peg 173 fits to secure the leg 105C to the overhang 170B. The dowel or peg 173 may be held in place by friction, adhesive, or any other mechanism known in the art to keep dowels or pegs 173 in place.

It is to be understood that the attachment techniques illustrated and described herein may be used in combination. For example, the techniques of FIGS. 3C and 3D may be combined so that the upper end 120C of the leg 105C shown in FIG. 3D is attached to a negative space 172 in a shim 175, rather than in a negative space 172 in the overhang 170B itself. It will be appreciated that different attachment techniques may be particularly attractive for items of furniture made from particular materials, although their use is not limited to such materials. For example, the embodiments of FIGS. 3C and 3F may be particularly attractive for items of furniture 100 made of wood. As another example, the embodiment of FIG. 3D may be particularly suitable for items of furniture with metal legs 105. As another example, the embodiment of FIG. 3E may be attractive for items of furniture made from a wide range of materials, including plastic, wood, and metal legs 105. The examples of materials provided herein in the context of the exemplary embodiments are not intended to be limiting. Likewise, other attachment techniques and/or fasteners for attaching the legs 105 to the overhangs 170 are not excluded.

When the item of furniture is intended as a seating apparatus (e.g., it is a chair, a sofa, etc.), the item of furniture may include a back portion 180. Referring again to FIGS. 1A-1C, the exemplary chair 100 includes an exemplary back portion 180A. In some embodiments, the back portion 180A and at least one leg 105 include features to facilitate attachment of the back portion 180A to the at least one leg 105. In the example shown in FIGS. 1B-1C, the back portion 180A includes the tenon tongues 194A and 194B, and, as described previously, the legs 105A and 105B include corresponding mortise holes 192A, 192B into which the tenon tongues 194A, 194B, respectively, fit. When the chair 100 is in assembled form, the tenon tongue 194A is seated in the mortise hole 192A, and the tenon tongue 194B is seated in the mortise hole 192B.

Figure 4A:
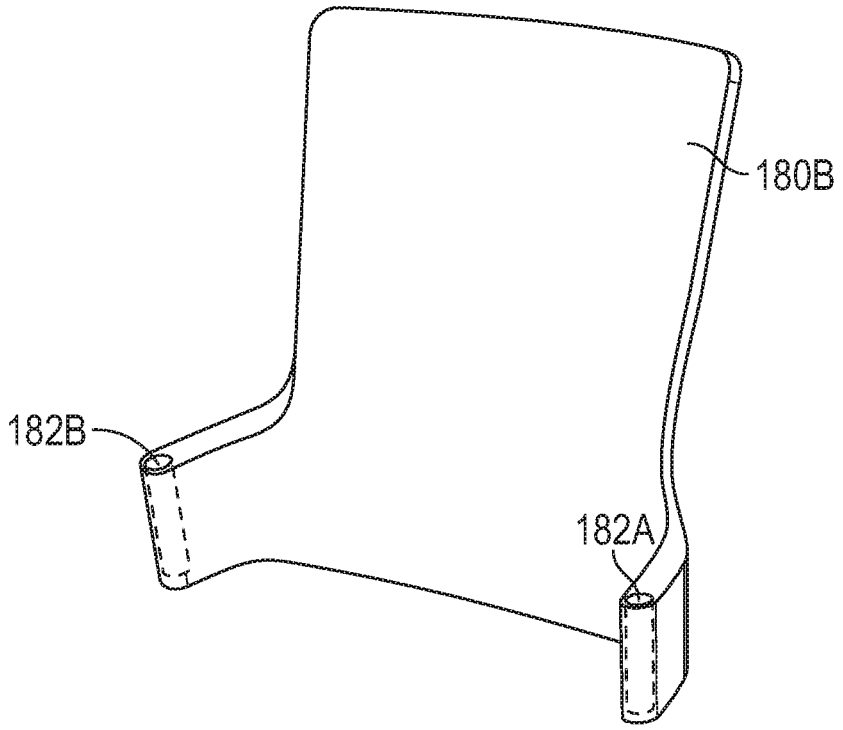
FIGS. 4A and 4B illustrate an exemplary back portion that may be incorporated into an item of furniture in accordance with some embodiments.
Figure 4B:
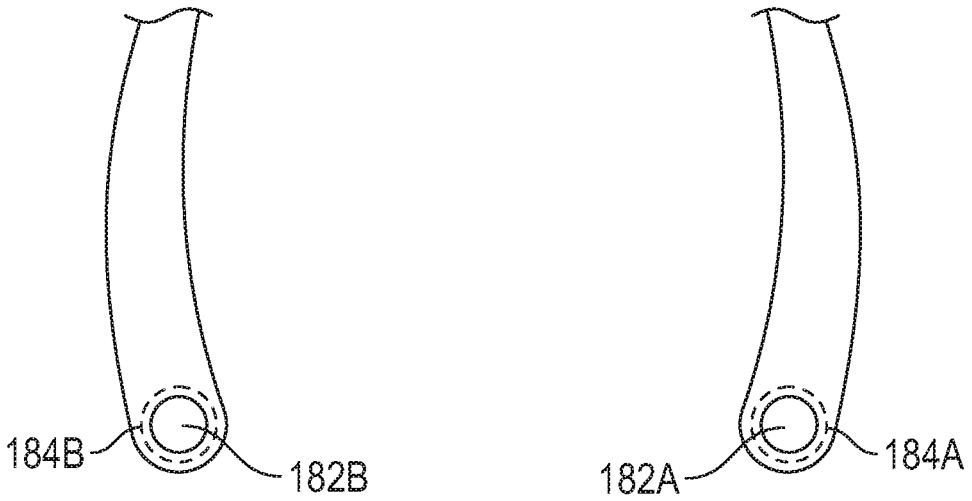

FIGS. 1B and 1C illustrate one way to attach a back portion 180 to an item of furniture such as a chair 100. It is to be understood that there are other ways to attach a back portion 180 to an item of furniture, and these ways are specifically contemplated herein. For example, in embodiments including a back portion 180, the legs 105 need not include any feature to facilitate attachment of the back portion 180. FIGS. 4A and 4B illustrate an exemplary embodiment of a back portion 180B that includes holes 182A and 182B to enable attachment of the back portion 180B to an item of furniture. The holes 182A, 182B have dimensions that enable the upper portions 140A, 140B of the legs 105A, 105B to extend through the holes 182A, 182B. To assemble the item of furniture (e.g., the chair 100), holes 182A, 182B in the back portion 180B are positioned between the top 160 and the overhangs 170A, 170B and aligned with the holes 166A, 166B so that the upper portion 140A of the leg 105A extends through the hole 166A and through the hole 182A before meeting the overhang 170A, and, likewise, the upper portion 140B of the leg 105B extends through the hole 166B and through the hole 182B before meeting the overhang 170B.

In some embodiments, the interior volume of each of the holes 182A, 182B in the back portion 180B is selected to prevent movement of the legs 105A, 105B after the item of furniture has been assembled. In some such embodiments, the holes 182A and 182B have shapes and dimensions that are approximately the same as, but slightly bigger than, the shapes and dimensions of the upper portions 140A, 140B so that the parts of the upper portions 140A, 140B in the holes 182A, 182B effectively fill the holes 182A, 182B.

It is to be understood that in addition to the disclosed features enabling the attachment of a back portion 180A, 180B to the chair 100, a back portion 180A, 180B may include other features that may be conventional. For example, the back portion 180A, 180B may comprise a frame with flexible netting stretched across the frame, against which a person's back can rest.

When the item of furniture is intended as a seating apparatus (e.g., a chair, a sofa, etc.), the item of furniture may include a seat cushion coupled to or resting on the upper surface 162 of the top 160. If present, the seat cushion may comprise any suitable material (e.g., cloth, leather, cardboard, etc.) and may have any suitable surface characteristics to provide the desired seating experience for a user. For example, the seat cushion, if present, may have a bottom surface with a shape that follows the curvature of the upper surface 162 of the top 160 and a top surface having a shape designed to be comfortable for a user seated in the seating apparatus.

Figure 5A:
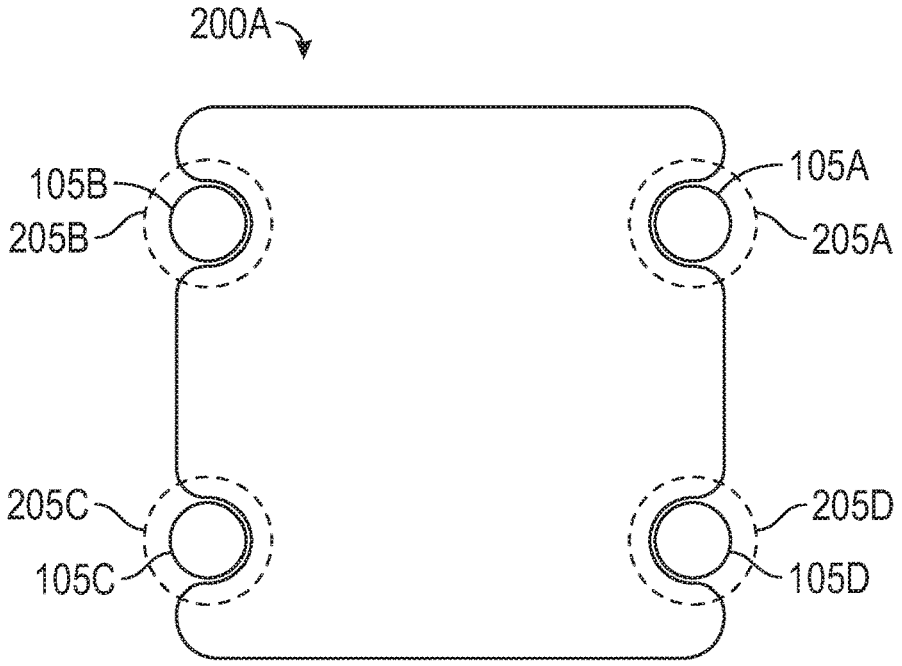
FIGS. 5A and 5B illustrate exemplary seat cushions that may be incorporated into an item of furniture in accordance with some embodiments.
Figure 5B:
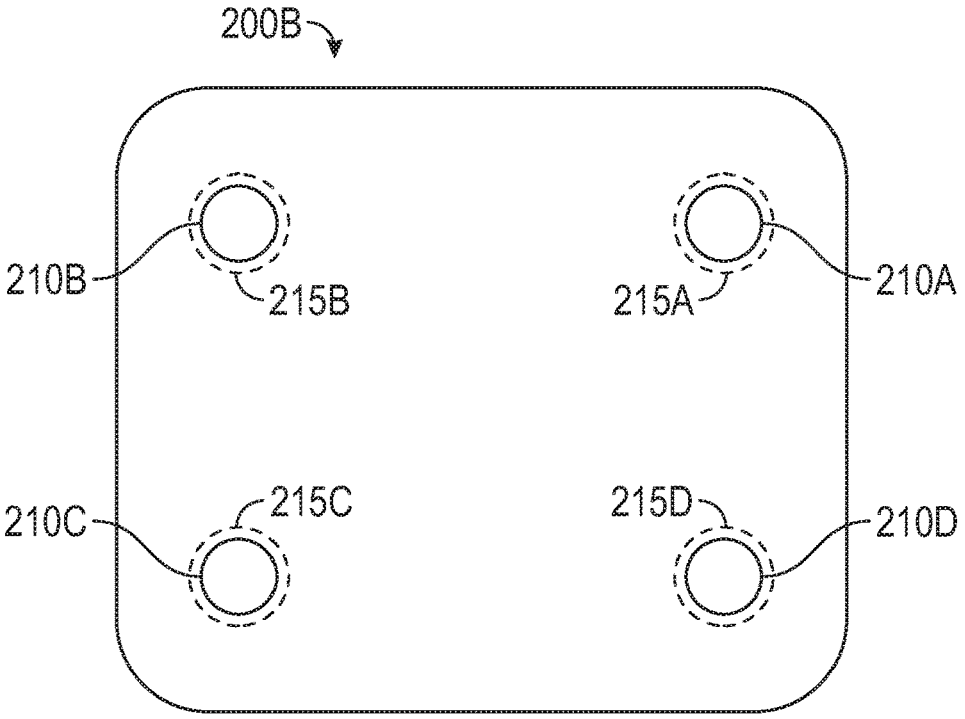

FIGS. 5A and 5B illustrate exemplary (optional) seat cushions that may be incorporated in an item of furniture in accordance with some embodiments. FIG. 5A is a top view of an exemplary (not to scale) seat cushion 200A for the exemplary chair 100 of FIGS. 1A-1C. The seat cushion 200A has four edge indentations 205A, 205B, 205C, and 205D. In some embodiments, the sizes and shapes of the edge indentations 205 are selected so that each of the legs 105 fits within the negative space created by a respective edge indentation 205. The exemplary seat cushion 200A provides several benefits, including that it may be positioned on the top 160 after the chair 100 has been assembled. In some embodiments, the edge indentations 205 are configured (i.e., their sizes and shapes are selected) such that once the seat cushion 200A is in place, the legs 105 prevent it from moving substantially. The seat cushion 200A may also be removable from the chair 100.

FIG. 5B is a top view of another exemplary (not to scale) seat cushion 200B for the exemplary chair 100 of FIGS. 1A-1C. The seat cushion 200B has four holes 210A, 210B, 210C, and 210D. Each hole 210 has a perimeter 215 that is at least slightly larger than the perimeter of the upper portion 140 of the respective leg 105 so that the upper portion 140 of the leg 105 can pass through the hole 210. In some embodiments, when the chair 100 is assembled, the seat cushion 200B is positioned on the top 160, and each of the legs 105 is then inserted through a respective hole 210 in the seat cushion 200B before being attached to an overhang 170.

FIGS. 1A-1C illustrate a chair 100 with a back portion 180A, but it is to be appreciated that other items of furniture may exclude the back portion 180A. For example, other items of furniture may comprise the legs 105 and working portion 150. As just one example, FIG. 6 illustrates an exemplary embodiment of a table or desk 300. The previous discussions of the legs 105 and the working portion 150 are applicable to the table or desk 300 shown in FIG. 6 and are not repeated here.

The various components of the items of furniture described herein (e.g., the chair 100, the table or desk 300, and other embodiments of items of furniture fabricated and assembled as described herein) may be made of any suitable material. For example, at least one of the working portion 150, the legs 105, and, if present, the back portion 180 may comprise a suitable wood (e.g., bamboo, ash, maple, birch, walnut, rosewood, fir, oak, cherry, teak, etc.), which may be finished or unfinished, natural or painted/stained, etc. As another example, at least one of the working portion 150, the legs 105, and, if present, the back portion 180 may comprise plastic. As yet another example, at least one of the working portion 150, the legs 105, and, if present, the back portion 180 may comprise metal. For example, in some embodiments, the working portion 150 and/or the back portion 180 (if present) comprises a sheet of metal that is bent or shaped (e.g., around a mold as described below for wood veneer sheets). In some embodiments, at least one of the working portion 150, the legs 105, and, if present, the back portion 180 may comprise a new or recycled composite material (e.g., a recycled composite material, carbon fiber, a thermoplastic composite material (e.g., which may be recycled by grinding finished parts into small particles that are then fed into an injection molding machine with virgin thermoplastic composite materials), a thermoset composite, etc.).

In some embodiments, at least a portion of an item of furniture comprises a plurality (i.e., at least two) of sheets of wood veneer (e.g., thin slices of wood, usually thinner than 3 mm (⅛ inch)). For example, as described in more detail below, the working portion 150 and/or the back portion 180 (if present) may be made from a plurality of wood veneer sheets.

Figure 7:
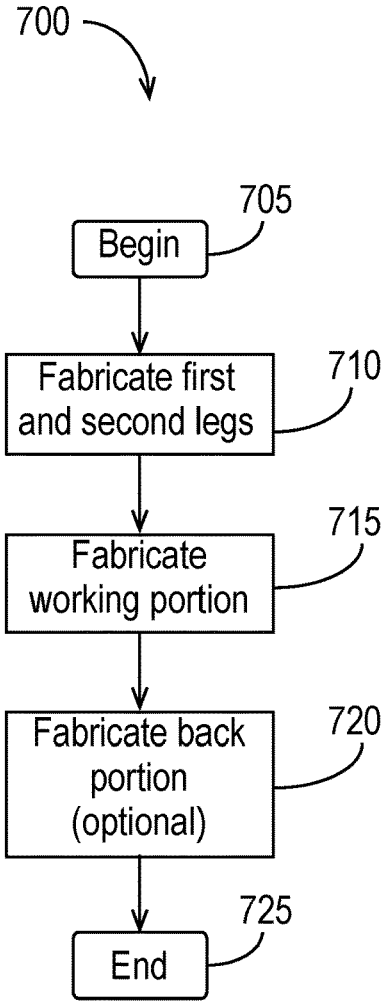
FIG. 7 is a flowchart illustrating a method of manufacturing the components of an item of furniture.

FIG. 7 is a flowchart illustrating a method 700 of manufacturing the components of an item of furniture. At 705, the method 700 begins. At 710, at least two legs 105 are fabricated. As described previously, each of the legs 105 has a floor-contacting end 110, an upper end 120, a lower portion 130 extending between the floor-contacting end 110 and an interface 115 between the floor-contacting end 110 and the upper end 120, and an upper portion 140 extending between the interface 115 and the upper end 120. The lower portion 130 of each leg 105 has a respective lower-portion outer perimeter 135 at the interface 115, and the upper portion 140 has a respective upper-portion outer perimeter 145 at the interface 115. The upper-portion outer perimeter 145 is smaller than the lower-portion outer perimeter 135.

The legs 105 may be fabricated using various techniques, alone or in combination. Examples of techniques that may be used to fabricate the legs 105 are milling, turning, threading, sanding, plating, anodizing, staining, applying urethane, oxidizing, grinding, filing, welding, die casting, and brazing.

In some embodiments, the legs 105 comprise wood. In such embodiments, the legs 105 may be fabricated by machining a piece of wood (e.g., by rotating a piece of wood about an axis (e.g., using a lathe) and, while the piece of wood is being rotated, removing a portion of the piece of wood). In some embodiments in which the item of furniture includes a back portion 180, fabricating the legs 105 comprises creating a mortise hole 192 in at least one of the legs 105. In such embodiments, the legs 105 may be, but need not be, cylindrical.

In some embodiments, fabricating the legs 105 comprises heating a material (e.g., plastic, metal, etc.) and placing the heated material in a mold having the shape of part or all of one of the legs 105. For example, part or all of a leg 105 may be fabricated using injection molding, casting, or any other suitable technique for forming parts.

In some embodiments in which the overhangs 170 include negative spaces 172 (e.g., recessed areas into which the upper ends 120 of the legs 105 extend when the item of furniture is assembled), fabricating the legs 105 may include creating a thread or other attachment feature on at least a portion of the upper portion 140. A thread may be created near the upper end 120 by any suitable technique. Examples of techniques that may be used include cutting, milling, molding, casting, rolling, grinding, lapping, and using an additive manufacturing technique.

In some embodiments, at least one leg 105 is fabricated by joining two pieces together. For example, fabricating the leg 105 may comprise joining the lower portion 130 to the upper portion 140. As another example, fabricating the leg 105 may comprise joining two pieces to create the lower portion 130 and the upper portion 140. FIG. 8 illustrates a leg 105 comprising a rod 186 and a washer 188 in accordance with some embodiments. Fabricating the leg 105 comprises inserting the rod 186 through a hole in the washer 188, and attaching the washer 188 to the rod 186. For example, the rod 186 may be a metal rod, and the washer 188 may be attached to the metal rod via threads or welding. The upper portion 140 is then the portion of the rod 186 on one side of the washer 188 (shown as the portion to the left of the washer 188 in FIG. 8), and the lower portion 130 is the portion of the leg 105 that includes the washer 188 and the portion of the rod 186 to the right of the washer 188. The interface 115 is also shown. In embodiments such as the one shown in FIG. 8, the metal rod and/or the washer may be substantially cylindrical, or they may have different shapes. Likewise, the washer 188 may have a surface that lies flush against the lower surface 164.

It is to be understood that the term "washer" is used more broadly herein than in the classical hardware sense. Whereas the traditional washer is a thin metal disk with a hole in the middle that is that is typically used to distribute the load of a threaded fastener (e.g., a screw or nut), the washer 188 includes the traditional washer as well as other objects that include a hole through which the rod 186 may be inserted and that can be attached to the rod 186 (e.g., via welding) to provide the interface 115. Specifically, the washer 188 need not be thin, metal, or disk-shaped.

In some embodiments, fabricating the legs 105 comprises staining or painting at least part of the legs 105.

Referring again to FIG. 7, at 715, a working portion 150 is fabricated. As described previously, the working portion 150 has a top 160, a first overhang 170A, and a second overhang 170B. The top 160 has an upper surface 162, a lower surface 164, and at least two holes 166. Each of the holes 166 extends between the lower surface 164 and the upper surface 162. The perimeter 168 of each hole 166 is smaller than the lower-portion outer perimeter 135 and larger than the upper-portion outer perimeter 145 of the leg 105 that will extend through the hole 166.

The working portion 150 may be fabricated using any suitable technique. For example, in some embodiments, fabricating the working portion 150 comprises heating a material (e.g., plastic, metal, etc.), and placing the heated material in a mold in the shape of part of or the entire working portion 150.

In some embodiments, the top 160 and overhangs 170 are separate pieces that are joined together to fabricate the working portion 150. In some such embodiments, the working portion 150 may be fabricated by fabricating the top 160, fabricating the overhangs 170A, 170B, and attaching the overhangs 170A, 170B to the top 160, either directly or through one or more intervening components (e.g., spacers, washers, etc.).

In some embodiments, fabricating the working portion 150 comprises coupling a leg receptacle (e.g., a negative space 172) to one or both of the overhangs 170. For example, as described previously, an overhang 170 may include a shim that houses a negative space 172.

In some embodiments, fabricating the working portion 150 comprises staining or painting at least part of the working portion 150.

Referring again to FIG. 7, optionally, at 720, a back portion 180 is fabricated. The back portion 180 may be fabricated using any suitable technique. For example, in some embodiments, fabricating the back portion 180 comprises heating a material (e.g., plastic, metal, etc.), and placing the heated material in a mold in the shape of part of or the entire back portion 180. In some embodiments in which the back portion 180 includes holes 182 through which the legs 105 extend to attach the back portion 180 to the item of furniture (e.g., as shown in FIGS. 4A and 4B), the holes 182 may be created at the same time the rest of the back portion 180 is fabricated, or they may be created by machining the back portion 180. For example, if the back portion 180 is fabricated using injection molding or die casting, the mold may include the holes 182.

Figure 9:
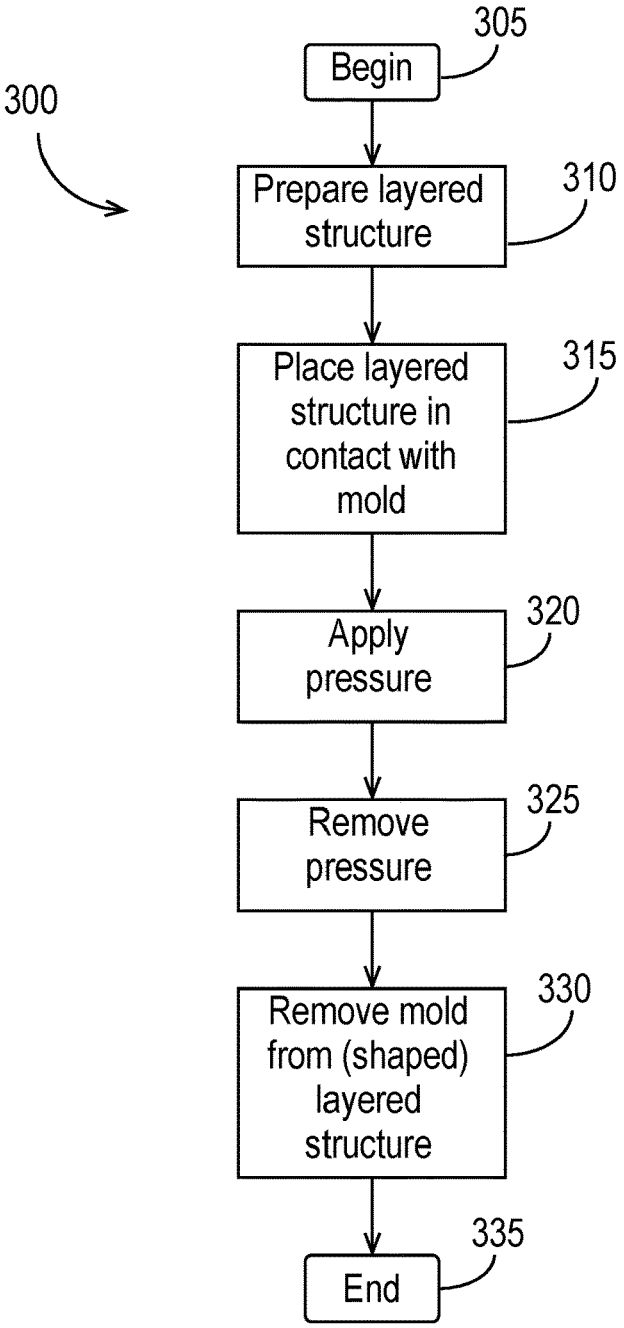
FIG. 9 is a flowchart illustrating a method of fabricating a component of an item of furniture in accordance with some embodiments.

As explained previously, in some embodiments, the working portion 150 is a unitary piece. Likewise, in some embodiments that include a back portion 180, the back portion 180 is also a unitary piece. FIG. 9 is a flowchart illustrating a method 300 of fabricating a component of an item of furniture (e.g., the working portion 150, a back portion 180, etc.) in accordance with some embodiments in which at least a portion of the item of furniture comprises a plurality of sheets of wood veneer. At 305, the method begins. At 310, a layered structure is prepared. The layered structure comprises at least first and second sheets of wood veneer with an adhesive between the two layers. Additional sheets of wood veneer may be added with adhesive between each pair of adjacent sheets of wood veneer. For example, the layered structure can be prepared by laying down (horizontally) a first sheet of wood veneer, then applying an adhesive to the upward-facing surface of the first sheet of wood veneer, and then laying down a second sheet of wood veneer on the adhesive. Additional layers of wood veneer may be added similarly (e.g., by applying adhesive to the upward-facing surface of the previous sheet of wood veneer, then laying down an additional sheet of wood veneer on the adhesive, etc.). Preferably, the adhesive used in the layered structure is of a type that remains pliable during steps 310 and 315 (described below) and hardens during step 320 (described below) of the method 300. For example, the adhesive may be a timed epoxy that cures only after steps 310 and 315 have been completed, and during the time that pressure is applied in step 320. To ensure that the adhesive hardens only when desired, the method may be performed under specific environmental conditions (e.g., within a specified temperature range, within a specified humidity range, etc.). As another example, the adhesive may be a wood glue.

At 315, the layered structure is placed in contact with a mold. The mold has a shape of the negative space of the component being fabricated so that when pressure is applied in step 320, the layered structure takes the shape of at least a portion of the outside surface of the mold. For example, the mold may have the shape of the negative space above the upper surface 162 of the top 160 and below the overhangs 170A, 170B of the working portion 150. As another example, the mold may have the shape of the negative space of the back portion 180A (i.e., space that would be occupied by a person's back if seated in the chair 100). The mold may be made of any material that maintains its size and shape when subjected to the pressure applied during step 320 (described below). For example, the mold may comprise metal, plastic, hard wood, etc.

At 320, pressure is applied (e.g., by creating a vacuum) to cause the layered structure to conform to the shape of the mold. During step 320, the adhesive hardens, thereby causing the layered structure to remain in the shape of at least a portion of the outer surface of the mold when the mold is removed. At 325, the pressure is removed. At 330, the mold is removed from the (now shaped) layered structure. In some embodiments, the mold has a narrower side and a wider side, and removing the mold from the layered structure comprises applying pressure to the narrower side of the mold to dislodge the mold from the layered structure. At 335, the method ends.

After completion of the method 300, the fabricated portion may be machined or further processed prior to assembly of the item of furniture. For example, when the working portion 150 is fabricated using the method 300, it may be necessary to create the holes 166A, 166B, 166C, and 166D (e.g., by machining). As another example, when the item of furniture includes a back portion 180A, it may be necessary to create the tenon tongues 194 (e.g., by machining the back portion 180A). As yet another example, it may be desirable to stain or paint at least part of the fabricated portion of the item of furniture. As yet another example, if may be desirable to sand, trim, or otherwise remove material from the portion of the item of furniture (e.g., to create the tenon tongues 194 of the back portion 180A, to smooth the edges of the back portion 180 or the working portion 150, etc.).

Figure 10A:
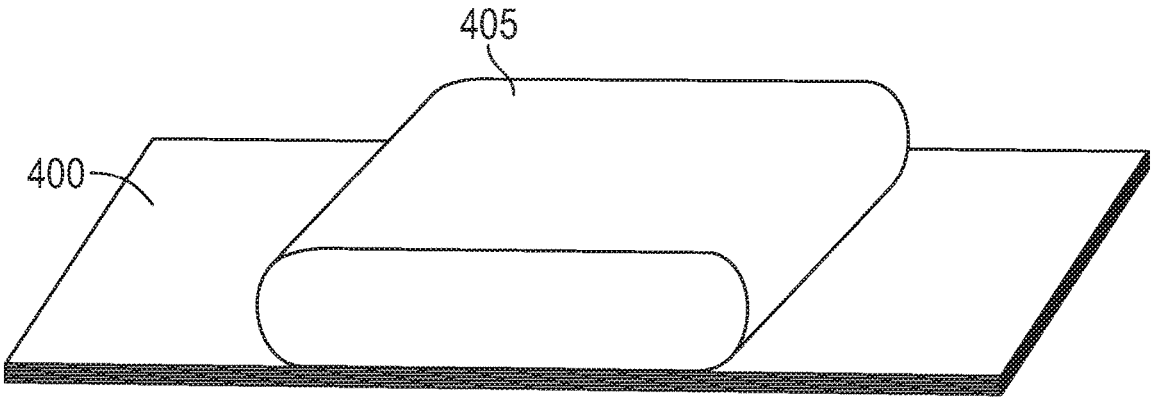
FIGS. 10A-10D illustrate a method of fabricating a component of an item of furniture in accordance with some embodiments.

FIGS. 10A-10D illustrate a method of fabricating a portion of an item of furniture in accordance with some embodiments. FIGS. 10A-10D illustrate the method as used to fabricate the working portion 150 of the chair 100, but it is to be appreciated that the method can be used to fabricate other portions of items of furniture (e.g., the back portion 180A, etc.). FIG. 10A illustrates a layered structure 400, which may be prepared as described previously, i.e., by stacking sheets of wood veneer with adhesive (e.g., a timed epoxy, wood glue, etc.) between each adjacent pair of wood veneer sheets. A mold 405 is placed in contact with the layered structure 400. As explained above, the mold 405 has an outer shape, at least a portion of which is the shape of the negative space of the portion of the item of furniture being fabricated (e.g., the working portion 150, the back portion 180A, etc.).

Figure 10B:
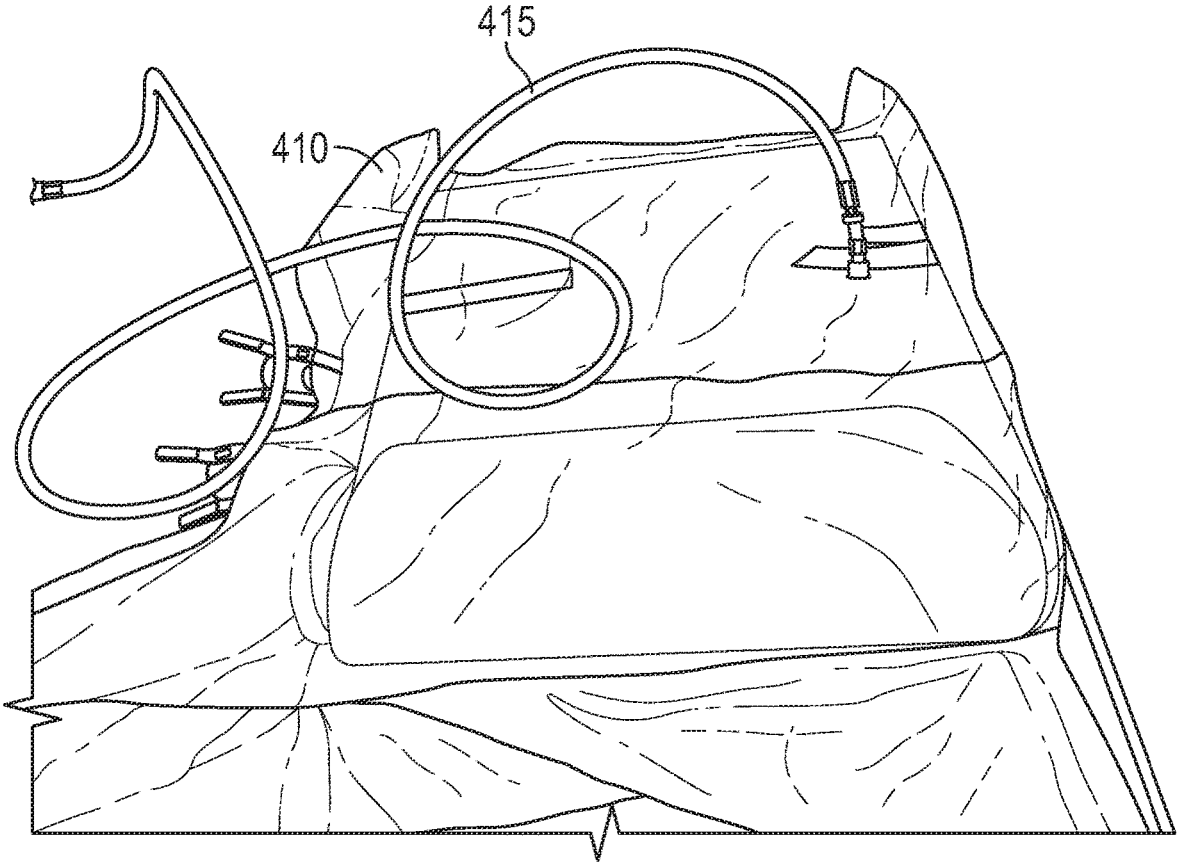
Figure 10C:
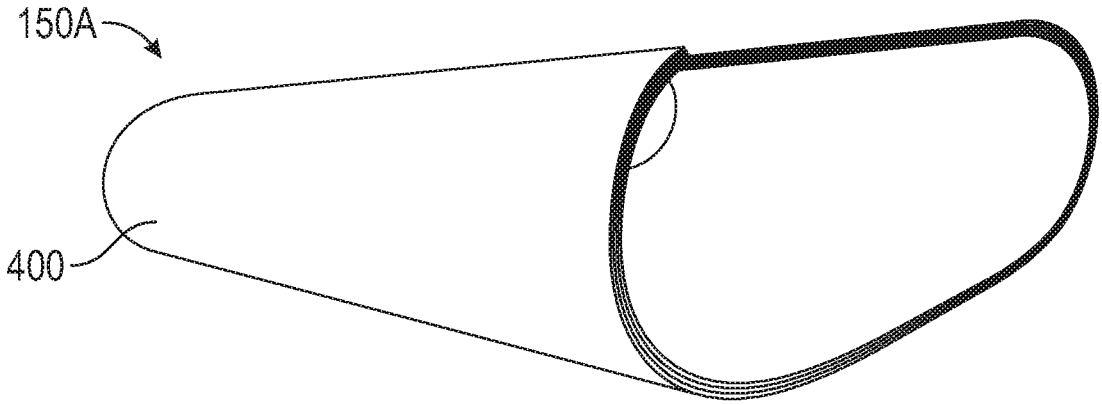
Figure 10D:
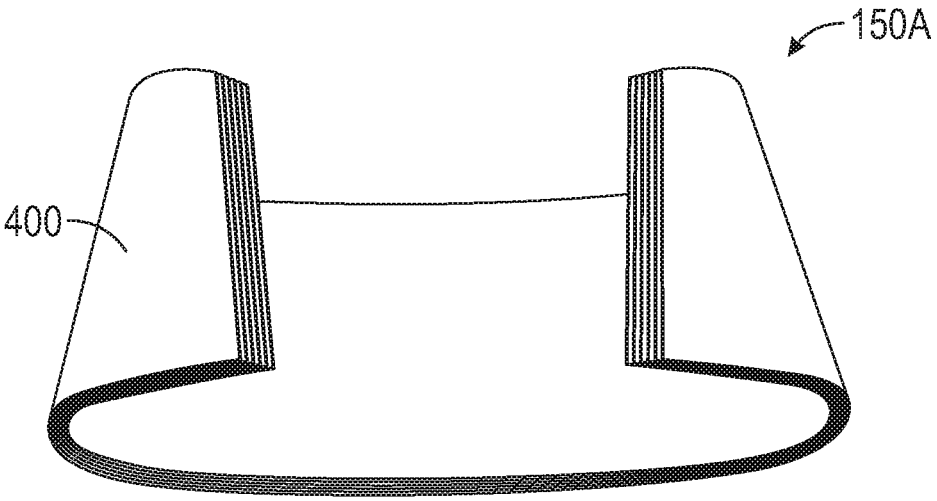

FIG. 10B illustrates one way in which step 320 of FIG. 9 can be accomplished, namely by placing the mold 405 and the layered structure 400 into vacuum bag 410 (with the mold 405 in contact with the layered structure 400 as shown, e.g., in FIG. 10A) and removing air from the vacuum bag 410 (e.g., using a hose 415) to cause the layered structure 400 to conform to the outside of the mold 405. After the layered structure 400 has conformed to the shape of the mold 405, and the adhesive between the sheets of wood veneer has hardened, the vacuum is removed (e.g., the pressure inside of the vacuum bag 410 is allowed to decrease), and the layered structure 400 and mold 405 are removed from the vacuum bag 410. The mold 405 is then removed (step 330 of FIG. 9). As FIG. 10C illustrates, the layered structure 400 (now an unfinished working portion 150A in the illustrated example) is in the shape of at least a portion of the outside of the mold 405. As shown in FIG. 10D, the edges of the sheets of wood veneer in the shaped-but-unfinished portion of the item of furniture may not be aligned after completion of the method 300. Consequently, it may be desirable to trim and/or finish some or all of the edges before assembling the item of furniture. For example, it may be desirable to remove edge material from the unfinished working portion 150A of FIG. 10D at the ends of the overhangs 170A, 170B to provide edges with the desired smoothness and/or appearance (e.g., as shown in the chair 100 of FIGS. 1A-1C).

In embodiments using a layered structure 400 for at least a portion of an item of furniture, the sheets of wood veneer in the layered structure 400 may all be of the same type of wood, or they may differ. For example, it may be desirable to a first type of wood for the sheets of wood veneer that are between the outermost sheets, and a second type of wood for the outermost sheets. The first type may be, for example, less expensive than the second type. In some embodiments, the layered structure 400 comprises at least three sheets of wood veneer, wherein the outermost layers are ash and the innermost layer(s) are birch.

Referring again to FIG. 7, at 725, the method ends.

It is to be understood that although the method 300 was explained assuming the layered structure 400 comprises sheets of wood veneer, in embodiments using layered structures 400, any suitable material may be used for the layers. For example, the layers may comprise wood (e.g., one or more of ash, walnut, birch, rosewood, cherry, maple, teak, oak, fir, etc.). As another example, the layers may comprise metal (e.g., steel, brass, copper, aluminum, etc.). As yet another example, the layers may comprise a composite material. The layered structure 400 may comprise bendable sheets of any material. The examples provided herein are not intended to be limiting.

Moreover, it is to be understood that the method 300 may be used with, for example, a single sheet of material. For example, instead of the layered structure 400, a single sheet of material (e.g., metal) may be placed in contact with the mold 405. Pressure may be applied at step 320 (e.g., by hand, by using a bending machine, etc.) to bend the single sheet around the mold 405. Alternatively, the component of the item of furniture (e.g., the working portion 150, the back portion 180A, etc.) may be made from a sheet of material by bending the sheet of material without the use of a mold 405.

Figure 11A:
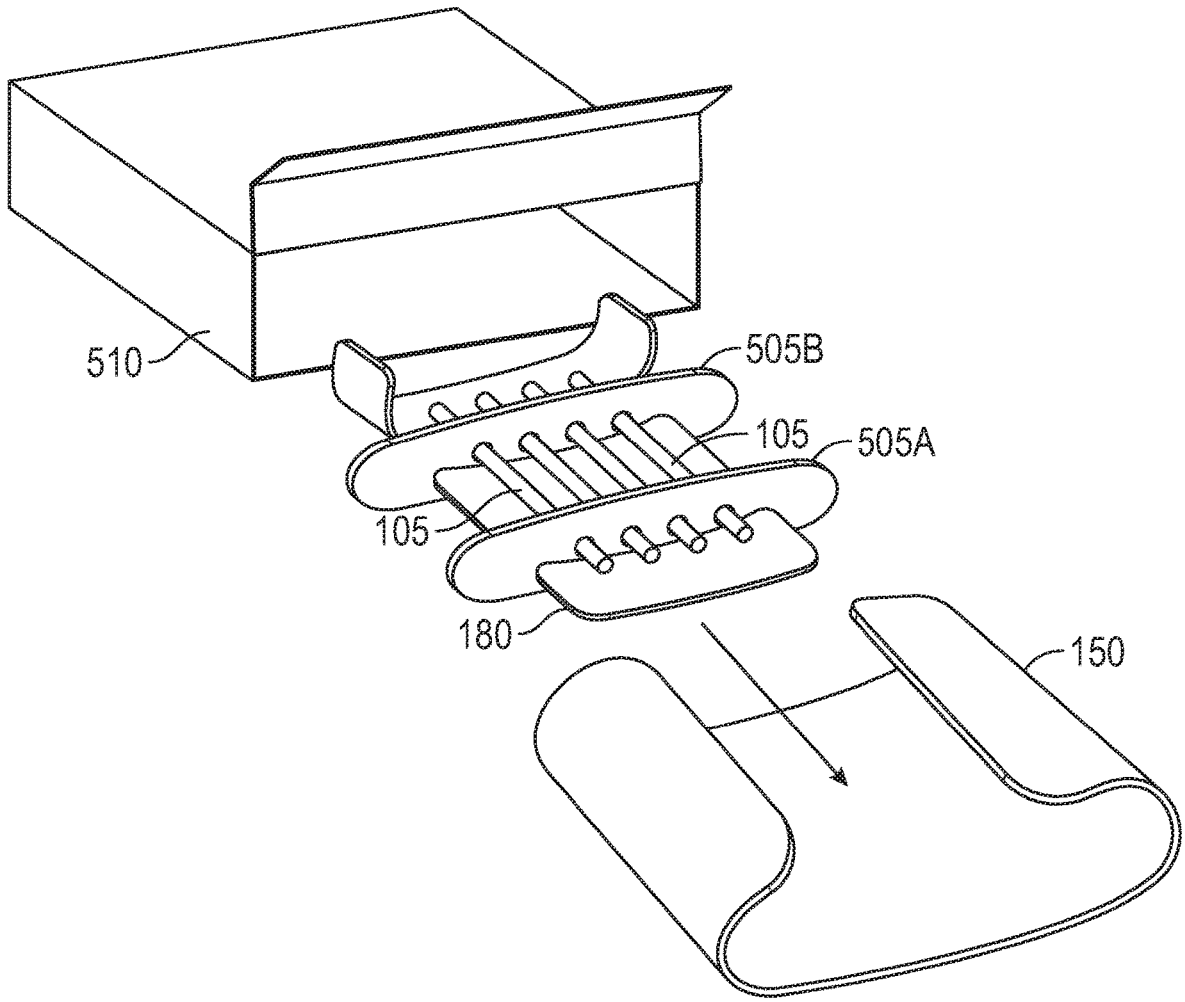
FIG. 11A illustrates an exemplary packaging configuration for an unassembled item of furniture in accordance with some embodiments.

One advantage of the items of furniture disclosed herein is that assembly can be straightforward and does not require the types or amounts of hardware typically required to assemble prior-art items of furniture. As a result, the embodiments disclosed herein are amenable to being packaged compactly, in an unassembled form, for shipment to customers (e.g., consumers, distributors, shops, etc.) for assembly. FIG. 11A illustrates one way in which an unassembled item of furniture, such as the chair 100 illustrated in FIGS. 1A-1C, may be packaged compactly in accordance with some embodiments. The illustrated embodiment may be particularly advantageous when the working portion 150 has a C-shape, as described previously. To simplify the drawing, FIG. 11A omits some details of the components of the chair 100 (i.e., the holes 166 in the working portion 150, the tenon tongues 194 of the back portion 180A, the holes 182 of the back portion 180B, the interfaces 115 of the legs 105, etc.). The back portion 180 (which may be, for example, the exemplary back portion 180A or 180B) and legs 105 are placed in at least one packaging insert 505, which, in the embodiment illustrated in FIG. 11A, fits snugly within the interior of the working portion 150 (as indicated by the arrow in FIG. 11A). The combined unit comprising the back portion 180, legs 105, packaging insert 505, and working portion 150 may be placed in a container (e.g., box 510), potentially after being placed into a second packaging insert to protect the combined unit from damage that might otherwise occur during shipment.

In the exemplary embodiment of FIG. 11A, the packaging insert 505 has a size and shape selected so that the packaging insert 505 fits snugly within the interior of the working portion 150 (i.e., once in position within the interior of the working portion 150, the packaging insert 505 does not move appreciably relative to the working portion 150, nor does it allow the back portion 180 or the legs 105 to move appreciably relative to each other or to the working portion 150). When in place in the interior of the working portion 150, the packaging insert 505 prevents the legs 105 from contacting the back portion 180 and also prevents the back portion 180 and the legs 105 from contacting the working portion 150.

In the exemplary embodiment of FIG. 11A, the packaging insert 505 comprises two panels, 505A and 505B. Each of the two panels 505A, 505B has a slot through which the back portion 180 fits. Each of the two panels 505A, 505B also has a number of holes equal to the number of legs 105, where the sizes of the holes are selected to hold the legs 105 in place within the packaging insert 505. In some embodiments in which the packaging insert 505 has two panels 505A, 505B, one of the two panels has holes sized for the upper portions 140 of the legs 105, and the other of the two panels has holes sized for the lower portions 130 of the legs 105.

FIG. 11A shows a packaging insert 505 that has two panels 505A, 505B that, when in place, are roughly perpendicular to the front of the back portion 180. In some embodiments, the packaging insert 505 comprises two portions that sit above and below the back portion 180 when it is oriented as shown in FIG. 11A, and the back portion 180 is sandwiched between the two portions. For example, the packaging insert 505 may comprise a first portion having a bottom surface that follows the shape of the top 160 and an upper surface that follows the shape of the back of the back portion 180, and a second portion that has a bottom surface that follows the shape of the front of the back portion 180 and a top that follows the shape of the underside of the overhangs 170A, 170B, such that the packaging insert 505 fits within the interior space of the working portion 150 when the back portion 180 has been sandwiched between the first and second portions. One or both of the two portions may also have holes through which the legs 105 are slid. Alternatively, one or both of the portions may comprise two pieces, and the legs 105 may be sandwiched between the two pieces.

The packaging insert 505, whether unitary or having multiple portions, may be made of any material providing enough structural rigidity to hold the components of the item of furniture in place and prevent the various components from contacting (and potentially damaging) each other during shipment. For example, the packaging insert 505 may comprise cardboard or Styrofoam.

Figure 11B:
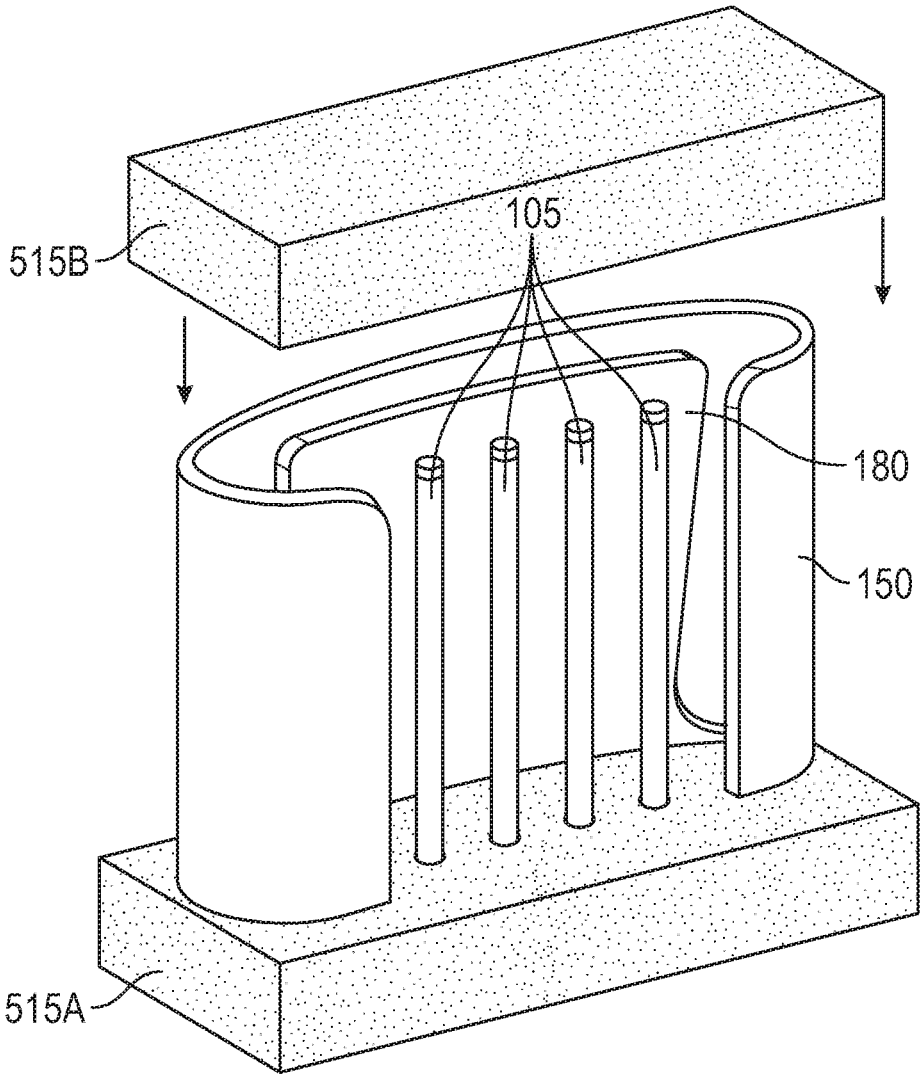
FIGS. 11B and 11C illustrate another exemplary packaging configuration for an unassembled item of furniture in accordance with some embodiments.
Figure 11C:
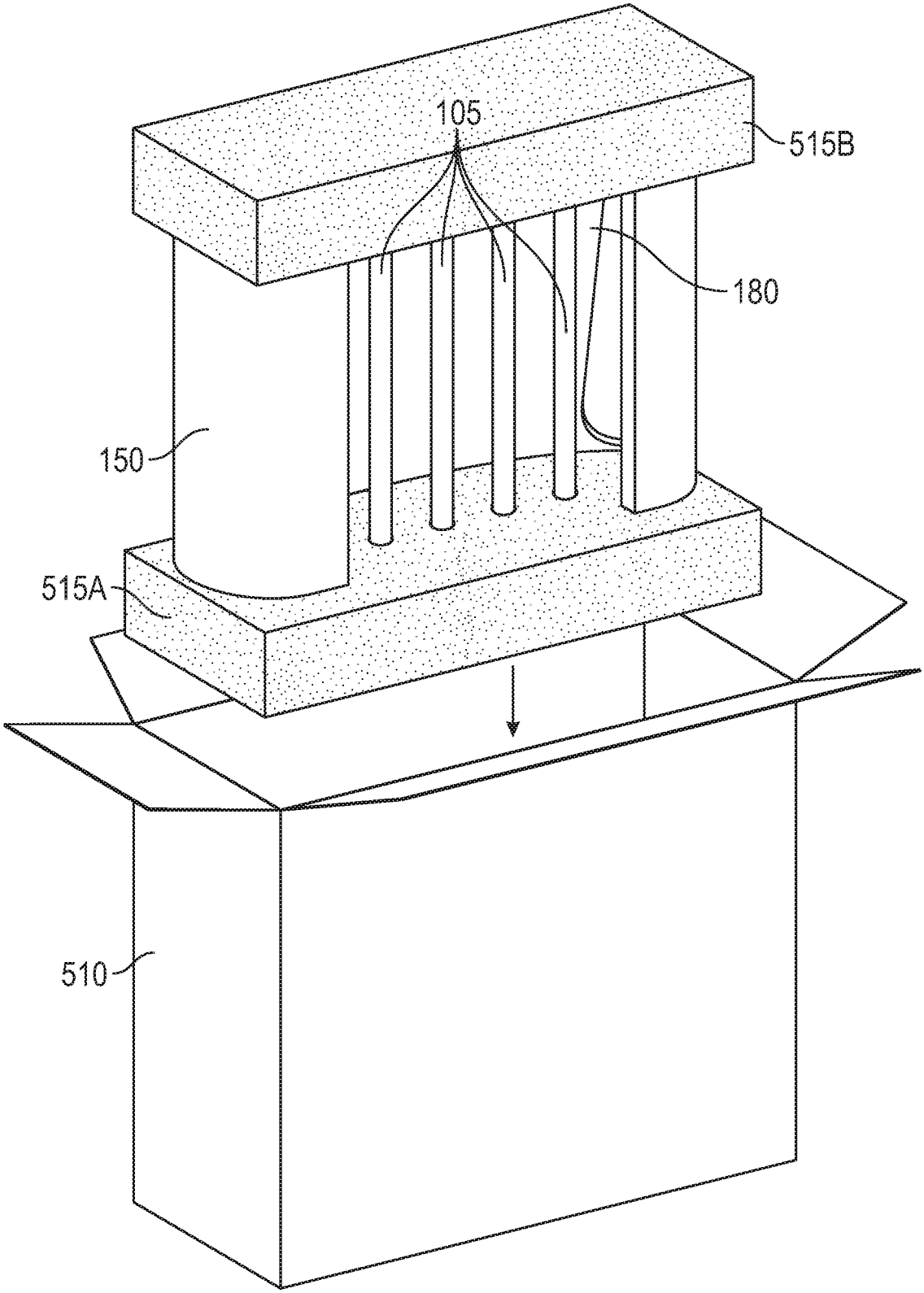

FIGS. 11B-11E illustrate another exemplary way that an unassembled item of furniture, such as the chair 100 illustrated in FIGS. 1A-1C, may be packaged compactly in accordance with some embodiments. The illustrated embodiment may be particularly advantageous when the working portion 150 has a C-shape. In the illustrated embodiment, the ends of the components of a chair 100 are situated in respective slots and holes in two packaging inserts 515A, 515B so as to secure the components of the item of furniture. As shown in FIGS. 11B and 11C, when secured by the packaging inserts 515A, 515B, the back portion 180 and legs 105 reside within the negative space of the working portion 150, which allows the item of furniture to be packaged compactly. To simplify the drawings, FIGS. 11B and 11C omit some details of the components of the chair 100 (i.e., the holes 166 in the working portion 150, the tenon tongues 194 of the back portion 180A, the holes 182 of the back portion 180B, the interfaces 115 on the legs 105, etc.).

Figure 11D:
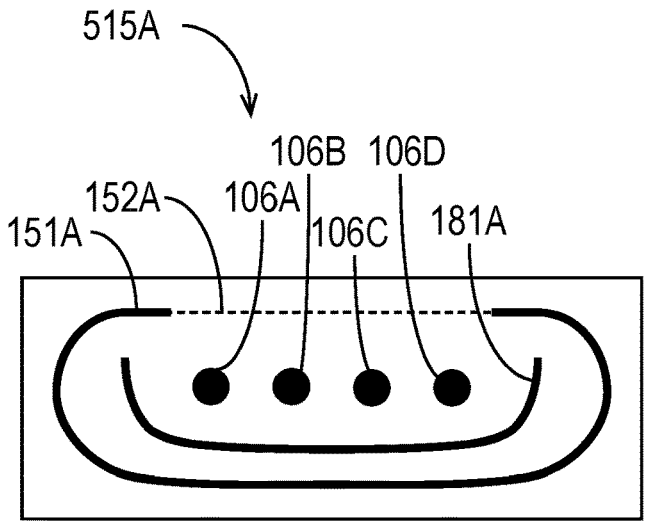
FIGS. 11D and 11E illustrate exemplary packaging inserts in accordance with some embodiments.
Figure 11E:
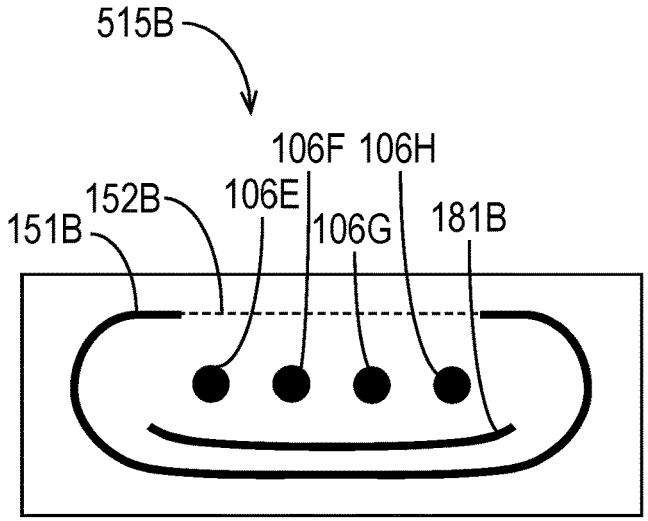

FIGS. 11D and 11E are views of the slots and holes in the packaging inserts 515A, 515B. As shown in FIG. 11D, the packaging insert 515A includes a slot 151A, a slot 181A, and holes 106A, 106B, 106C, and 106D. The slot 151A encloses the slot 181A, which, in this context, means that the slot 181A resides entirely within the area defined by the perimeter 152A shown in FIG. 11D. The perimeter 152A is the perimeter of the shape formed by the slot 151A when its endpoints are connected as shown by the dashed line in FIG. 11D. The slot 151A also encloses the holes 106A, 106B, 106C, and 106D. The slot 151A has a size and shape selected to fit, and secure in place, either the front edge or the back edge of the working portion 150, where the front edge is the edge visible in FIGS. 1A, 1B, and 3A, and the back edge is the edge visible in FIGS. 1C and 3B.

The slot 181A has a size and shape selected to fit, and to secure in place, either the lower or upper edge of the back portion 180, where the lower edge is the edge closer to the working portion 150 when the chair 100 is assembled. FIG. 11D illustrates the slot 181A sized to fit the lower edge of the back portion 180A illustrated in FIGS. 1A through 1C. It is to be understood that the slot 181A may alternatively be sized to fit the lower edge of the back portion 180B (shown in FIGS. 4A and 4B), or the upper edge of either of the back portions 180A, 180B.

Each of the holes 106A, 106B, 106C, 106D has a size and shape selected to fit, and to secure in place, either the floor-contacting end 110 or the upper end 120 of one of the legs 105A, 105B, 105C, 105D. It is to be understood that different holes 106 may fit different ends of the legs 105. For example, one hole 106A might fit the floor-contacting end 110A of the leg 105A, and another hole 106B might fit the upper end 120B of the leg 105B, etc. It is also to be understood that although FIGS. 11B through 11E illustrate four legs 105, as explained elsewhere herein, an item of furniture may have as few as two legs 105.

As shown in FIG. 11E, the packaging insert 515B includes a slot 151B, a slot 181B, and holes 106E, 106F, 106G, and 106H. The slot 151B encloses the slot 181B and the holes 106E, 106F, 106G, and 106H (i.e., the slot 181B and the holes 106E, 106F, 106G, and 106H reside entirely within the area defined by the perimeter 152B shown in FIG. 11E). The slot 151B has a size and shape selected to fit, and secure in place, whichever edge of the working portion is not secured by the slot 151A of the packaging insert 515A. The slot 181B has a size and shape selected to fit, and to secure in place, whichever edge of the back portion is not secured by the slot 181A of the packaging insert 515A. Similarly, each of the holes 106E, 106F, 106G, 106H has a size and shape selected to fit, and to secure in place, whichever end of the respective leg 105 is not secured by the holes 106A, 106B, 106C, 106D.

To prepare the unassembled item of furniture for packaging, the back portion 180 (which may be, for example, the exemplary back portion 180A or 180B), working portion 150, and legs 105 may be placed in the slots 181A, 151A and holes 106A-106D of the first packaging insert 515A as shown in FIGS. 11B and 11C. The second packaging insert 515B, with slots 181B, 151B and holes 106E-106H into which the other ends of the back portion 180, working portion 150, and legs 105 fit, may then be placed over the exposed ends of the working portion 150, legs 105, and back portion 180. As shown in FIG. 11C, the combined unit comprising the back portion 180, legs 105, working portion 150, and packaging inserts 515A, 515B, which secure the back portion 180, legs 105, and working portion 150, may be placed in a container (e.g., box 510) for shipment.

It is to be understood that placing the second packaging insert 515B over the exposed ends/edges of the working portion 150, legs 105, and back portion 180 is equivalent to placing the exposed ends/edges of the working portion 150, legs 150, and back portion 180 into the designated slots 151B, 181B and holes 106E through 106H of the second packaging insert 515B. It is also to be understood that although FIGS. 11B-11E illustrate a chair 100 with a back portion 180 and four legs 105, the disclosed configurations and methods may be used for items of furniture that do not include a back portion 180. Likewise, the disclosed configurations and methods may be used for items of furniture that have fewer than four legs 105.

As explained above, the packaging inserts 515A, 515B have sizes and shapes selected so that the packaging inserts 515A, 515B fit snugly around the ends/edges of the components of the item of furniture so that the components do not move appreciably relative to each other. When in place, the packaging inserts 515A, 515B prevent the legs 105 from contacting the back portion 180 and also prevent the back portion 180 and the legs 105 from contacting the working portion 150.

The packaging inserts 515A, 515B may be made of any material providing enough structural rigidity to protect the components of the item of furniture, and to hold the components of the item of furniture in place and prevent the various components from contacting (and potentially damaging) each other during shipment. For example, the packaging inserts 515A, 515B may comprise cardboard or Styrofoam. Furthermore, the packaging inserts 515A, 515B may have any dimensions enabling them to hold the components of the item of furniture in place and prevent the various components from contacting (and potentially damaging) each other during shipment.

Figure 12:
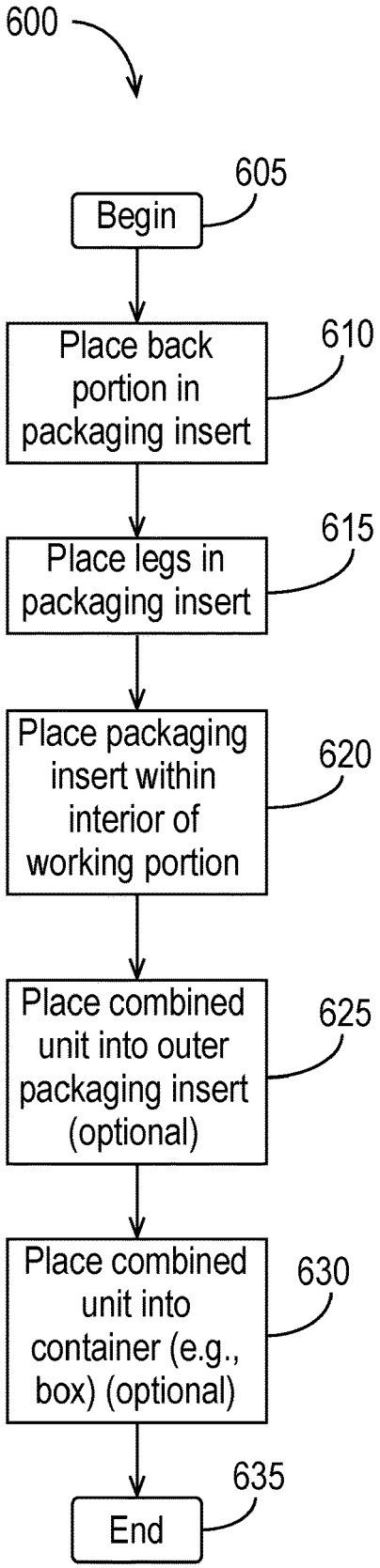
FIG. 12 is a flowchart illustrating a method of packaging an unassembled item of furniture in accordance with some embodiments.

FIG. 12 is a flowchart illustrating a method 600 of packaging an unassembled item of furniture in accordance with some embodiments. The method 600 may be used, for example, with embodiments such as illustrated in FIG. 11A. In the discussion below, the item of furniture is assumed to be a chair 100, but it is to be appreciated that packaging other items of furniture with fewer or more parts may also be accomplished using the disclosed method with modifications that will be evident to a person having ordinary skill in light of the disclosures herein. At 605, the method 600 begins. At 610, the back portion 180 is placed in a packaging insert 505, described above. The packaging insert 505 may include multiple parts, e.g., the panels 505A, 505B. The outer portion of the packaging insert 505 (e.g., its outer perimeter or surface area) is of a size and shape selected so that the packaging insert 505 fits snugly within the interior of the working portion 150. At 615, the legs 105 are placed in the packaging insert 505. At 620, the packaging insert 505 is placed within the interior of the working portion 150. Optionally, at 625, the combined unit (in the case of a chair 100, the working portion 150, back portion 180, and legs 105) is placed into an outer packaging insert (e.g., Styrofoam, cardboard, etc. having a shape to protect the combined unit during shipment). At 630, the combined unit, potentially in an outer packaging insert, is optionally placed into a container (e.g., a box 510). At 635, the method 600 ends.

It is to be appreciated that the steps of the method 600 need not be completed in the order in which they appear in the flowchart of FIG. 12. For example, steps 610, and 615 may be performed after step 620. As another example, step 615 may be performed before step 610. As yet another example, step 620 may be performed before one or both of steps 610 and 615.

In some embodiments, a packaged, unassembled item of furniture comprises a working portion 150, a back portion 180, at least two legs 105, and a packaging insert 505 (which may comprise, e.g., panels 505A, 505B). The packaging insert 505 has at least one slot and at least two holes. The back portion 180 extends through the slot of the packaging insert 505, and the legs 105 extend through respective holes in the packaging insert 505 such that the legs 105 are not in contact with each other or the back portion 180. The packaging insert 505 is positioned within the interior space of the working portion 150. As a result, the back portion 180 does not touch any of the legs 105 or the working portion 150. Likewise, the legs 105 do not touch each other, the back portion 180, or the working portion 150.

As explained above, the packaging insert 505 may comprise at least one panel (e.g., 505A and/or 505B). The panel 505A, 505B may be perpendicular to the top 160 of the working portion 150 and held in place by the overhangs 170A, 170B. The panel 505A, 505B may comprise cardboard, Styrofoam, or any other suitable material.

Figure 13:
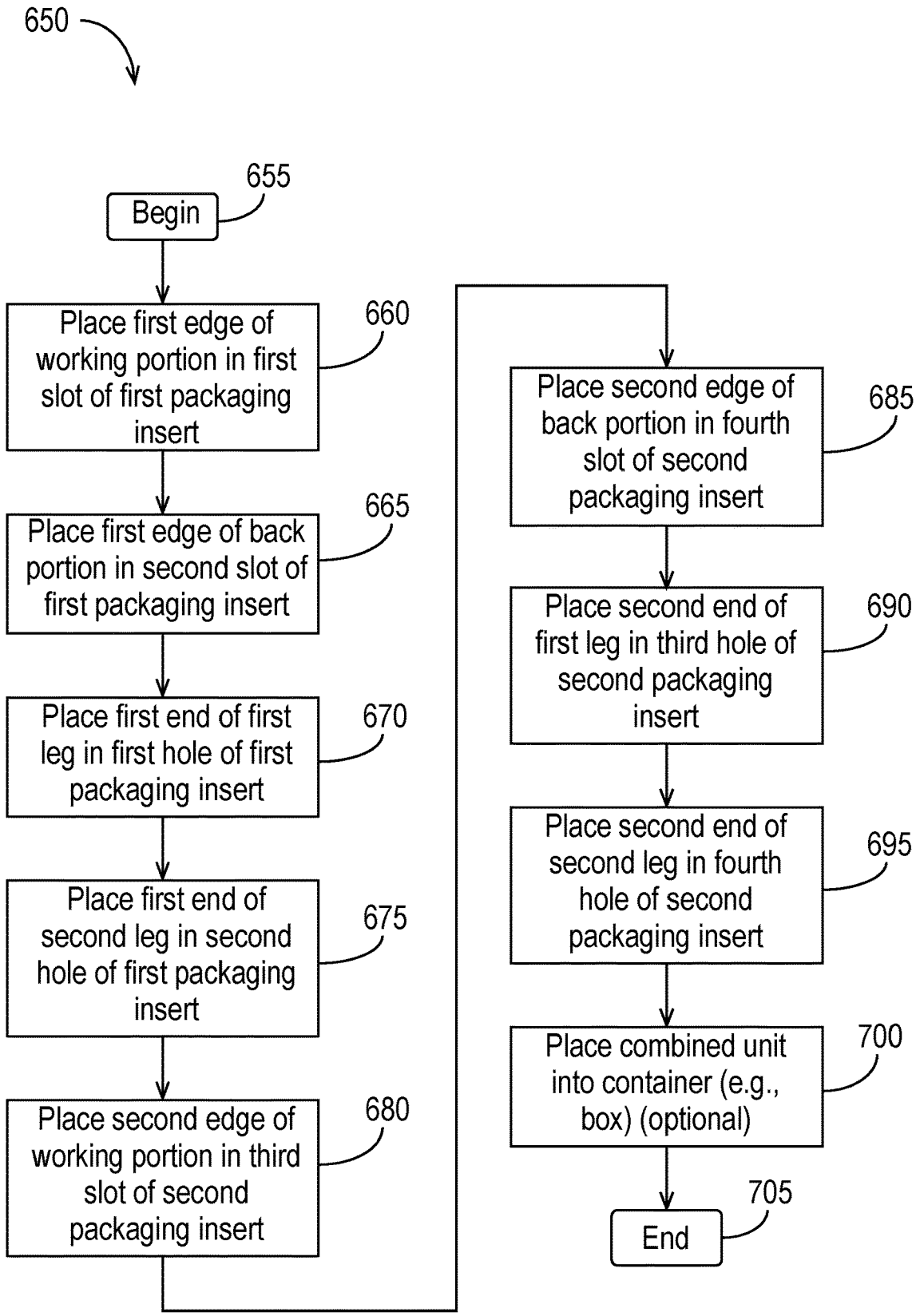
FIG. 13 is a flowchart illustrating a method of packaging an unassembled item of furniture in accordance with some embodiments.

FIG. 13 is a flowchart illustrating a method 650 of packaging an unassembled item of furniture in accordance with some embodiments. The method 650 may be used, for example, with embodiments such as illustrated in FIGS. 11B and 11C. In the discussion below, the item of furniture is assumed to be a chair 100, but it is to be appreciated that packaging other items of furniture with fewer or more parts may also be accomplished using the disclosed method with modifications that will be evident to a person having ordinary skill in light of the disclosures herein. The unassembled item of furniture comprises a working portion 150, a back portion 180, and first and second legs 105. The working portion 150 has first and second edges. One of the first and second edges is the front edge of the working portion 150, and the other of the first and second edges is the back edge of the working portion 150, both of which were described above in the context of FIGS. 11B and 11C. The back portion 180 also has first and second edges. One of the first and second edges is the lower edge of the back portion 180, and the other of the first and second edges is the upper edge of the back portion 180, both of which were described above in the context of FIGS. 11B and 11C. Each of the first and second legs 105 has a floor-contacting end 110 and an upper end 120 as described previously, for example, in the context of FIGS. 1A-1C and 2A-2D.

At 655, the method 650 begins. At 660, the first edge of the working portion 150 (i.e., the front edge or the back edge) is placed into a first slot 151A of a first packaging insert 515A. At 665, the first edge of the back portion 180 (i.e., the lower edge or the upper edge) is placed into a second slot 181A of the first packaging insert 515A. The second slot 181A is enclosed by the first slot 151A, as described above. At 670 and 675, the first ends of the first and second legs 105 are placed into first and second holes 106 in the first packaging insert 515A. At 680, the second edge of the working portion 150 is placed into a third slot 151B of a second packaging insert 515B. At 685, the second edge of the back portion 180 is placed in to a fourth slot 181B of the second packaging insert 515B. At 690 and 695, the second ends of the first and second legs 105 are placed into third and fourth holes 106 in the second packaging insert 515B. Optionally, at 700, the combined unit, comprising the working portion 150, the back portion 180, and legs 105 secured in the packaging inserts 515A, 515B, is placed into a container (e.g., a box 510). At 705, the method 650 ends.

It is to be appreciated that the steps of the method 650 need not be completed in the order in which they appear in the flowchart of FIG. 13. For example, steps 660, 665, 670, and 675 may be performed in any order. Similarly, steps 680, 685, 690, and 695 may be performed, in any order, before steps 660, 665, 670, and 675.

Figure 14:
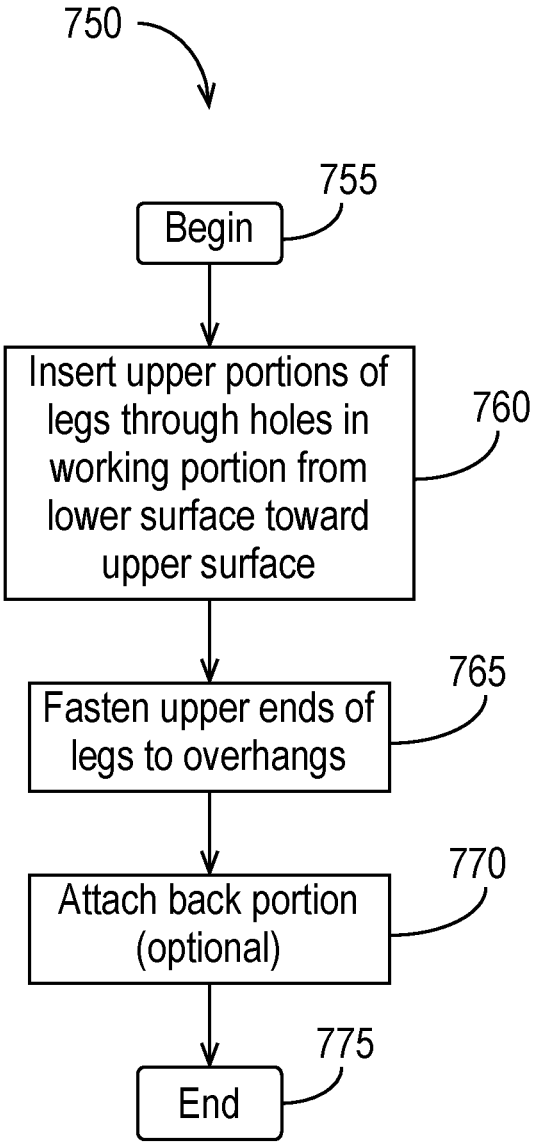
FIG. 14 is a flowchart illustrating a method of assembling an item of furniture in accordance with some embodiments.

The items of furniture disclosed herein can be assembled using a simple process. FIG. 14 is a flowchart illustrating a method 750 of assembling an item of furniture in accordance with some embodiments. At 755, the method begins. At 760, the upper portions 140 of the legs 105 are inserted through holes 166 in the working portion 150 in the direction from the lower surface 164 to the upper surface 162 of the top 160. At 765, the upper end 120 of each leg 105 is attached to one of the overhangs 170A, 170B. In some embodiments, as explained above, one or both of the overhangs 170 comprises a negative space 172 (e.g., a recess, a leg receptacle, etc.), and the upper end 120 extends into the negative space 172 for fastening. In some embodiments, the overhang 170 includes a threaded hole, and the upper portion 140 includes a thread near the upper end 120, and the leg 105 is fastened to the overhang 170 by mating the threat to the threaded hole. In some embodiments, fastening the legs 105 to the overhangs 170 comprises applying adhesive to the upper ends 120, to the overhangs 170, or to both. Exemplary ways to attach the legs 105 to the overhangs 170 were described in the discussion of FIGS. 3A-3F.

Referring again to FIG. 14, optionally, at 770, a back portion 180 is attached (e.g., if the item of furniture is a chair 100 that includes a back portion 180A, 180B). As explained above, the back portion 180A may be attached by inserting a tenon tongue 194 of the back portion 180A into a mortise hole 192 of a leg 105. In other embodiments, the back portion 180B may be attached by inserting the legs 105 through holes 182 in the back portion 180B prior to attaching the legs 105 to the overhangs 170. At 775, the method ends.

It is to be appreciated that certain steps in the method 750 need not be performed in the order illustrated, such as, for example, when the item of furniture being assembled includes a back portion 180. If the back portion 180 is similar to the back portion 180A illustrated in FIGS. 1B and 1C, it may be easiest to attach the back portion 180A only after completion of both steps 760 and 765, although it is possible to attach the back portion 180A to the legs 105A, 105B before completing step 765. In contrast, if the back portion 180 is similar to the back portion 180B illustrated in FIGS. 4A and 4B, the back portion is attached after step 760 but before step 765. Thus, in some embodiments, attaching the back portion 180B comprises positioning the back portion 180B relative to the working portion 150 so that the hole 182A is aligned with the hole 166A in the top 160 and between the top 160 and the overhang 170A, and the hole 182B is aligned with the hole 166B in the top 160 and between the top 160 and the overhang 170B, and then inserting the leg 105A through both holes 166A and 182A before fastening the upper end 120A to the overhang 170A, and inserting the leg 105B through both holes 166B and 182B before fastening the upper end 120B to the overhang 170B.

In the foregoing description and in the accompanying drawings, specific terminology has been set forth to provide a thorough understanding of the disclosed embodiments. In some instances, the terminology or drawings may imply specific details that are not required to practice the invention. To avoid obscuring the present disclosure unnecessarily, certain components are shown in block diagram form and/or are not discussed in extensive detail.

Unless otherwise specifically defined herein, all terms are to be given their broadest possible interpretation, including meanings implied from the specification and drawings and meanings understood by those skilled in the art and/or as defined in dictionaries, treatises, etc. As set forth explicitly herein, some terms may not comport with their ordinary or customary meanings.

As used in the specification and the appended claims, the singular forms "a," "an" and "the" do not exclude plural referents unless otherwise specified. The word "or" is to be interpreted as inclusive unless otherwise specified. Thus, the phrase "A or B" is to be interpreted as meaning all of the following: "both A and B," "A but not B," and "B but not A." Any use of "and/or" herein does not mean that the word "or" alone connotes exclusivity.

Whether followed by a conjunctive list having the form "A, B, and C," or a disjunctive list having the form "A, B, or C," the phrases "one or more of" and "at least one of" as used herein encompass all of the following combinations: (1) A only, (2) B only, (3) C only, (4) both A and B, (5) both A and C, (6) both B and C, (7) all of A, B, and C. Likewise, the phrase "one or both of A and B" means "A but not B," "B but not A," and "both A and B."

The term "coupled" is used herein to express a direct connection as well as a connection through one or more intervening parts or structures (e.g., hardware, etc.). To the extent that the terms "include(s)," "having," "has," "with," and variants thereof are used herein, such terms are intended to be inclusive in a manner similar to the term "comprising," i.e., meaning "including but not limited to." The terms "exemplary" and "embodiment" are used to express examples, not preferences or requirements.

The terms "over," "under," "between," and "on" are used herein refer to a relative position of one feature with respect to other features. For example, one feature disposed "over" or "under" another feature may be directly in contact with the other feature or may have intervening parts. Moreover, one feature disposed "between" two features may be directly in contact with or connected to the two features or may have one or more intervening features or parts. In contrast, a first feature "on" a second feature is in contact with that second feature.

The abbreviation "e.g." is used herein to mean "for example." Examples provided are explicitly not intended to be limiting. The abbreviation "i.e." is used herein to mean "that is."

The drawings are not necessarily to scale, and the dimensions, shapes, and sizes of the features may differ substantially from how they are depicted in the drawings.

Although the invention has been described with respect to certain embodiments, various variations and modifications may be effected without departing from the spirit and scope of the novel concepts of the disclosure. Unless explicitly stated herein, features and functions of different embodiments disclosed and discussed herein may be combined. Multiple exemplary configurations have been illustrated and discussed, but they are by no means a complete set of embodiments enabled by the inventive concepts disclosed herein. The invention is not to be limited by the disclosed embodiments, as changes and modifications can be made that are within the full intended scope of the invention as defined by the following claims.

I claim:

1. An item of furniture, comprising:

a first leg having a first floor-contacting end and a first upper end, the first leg comprising:

a first lower portion extending between the first floor-contacting end and a first interface between the first floor-contacting end and the first upper end, the first lower portion having a first lower-portion outer perimeter at the first interface, and a first upper portion extending between the first interface and the first upper end, the first upper portion having a first upper-portion outer perimeter at the first interface, the first upper-portion outer perimeter being smaller than the first lower-portion outer perimeter;

a second leg having a second floor-contacting end and a second upper end, the second leg comprising:

a second lower portion extending between the second floor-contacting end and a second interface between the second floor-contacting end and the second upper end, the second lower portion having a second lower-portion outer perimeter at the second interface, a second upper portion extending between the second interface and the second upper end, the second upper portion having a second upper-portion outer perimeter at the second interface, the second upper-portion outer perimeter being smaller than the second lower-portion outer perimeter;

a third leg having a third floor-contacting end and a third upper end, the third leg comprising:

a third lower portion extending between the third floor-contacting end and a third interface between the third floor-contacting end and the third upper end, the third lower portion having a third lower-portion outer perimeter at the third interface, and a third upper portion extending between the third interface and the third upper end, the third upper portion having a third upper-portion outer perimeter at the third interface, the third upper-portion outer perimeter being smaller than the third lower-portion outer perimeter;

a fourth leg having a fourth floor-contacting end and a fourth upper end, the fourth leg comprising:

a fourth lower portion extending between the fourth floor-contacting end and a fourth interface between the fourth floor-contacting end and the fourth upper end, the fourth lower portion having a fourth lower-portion outer perimeter at the fourth interface, a fourth upper portion extending between the fourth interface and the fourth upper end, the fourth upper portion having a fourth upper-portion outer perimeter at the fourth interface, the fourth upper-portion outer perimeter being smaller than the fourth lower-portion outer perimeter; and a working portion comprising:

a top having an upper surface and a lower surface, the top comprising a first hole, a second hole, a third hole, and a fourth hole, each of the first, second, third, and fourth holes extending between the lower surface and the upper surface, a first overhang, and a second overhang, wherein:

the working portion is generally horizontal, a perimeter of the first hole at the lower surface is smaller than the first lower-portion outer perimeter and larger than the first upper-portion outer perimeter, the first leg extends through the first hole, the first lower portion contacts the lower surface at the first interface, the first upper end is coupled to the first overhang, a perimeter of the second hole at the lower surface is smaller than the second lower-portion outer perimeter and larger than the second upper-portion outer perimeter, the second leg extends through the second hole, the second lower portion contacts the lower surface at the second interface, the second upper end is coupled to the second overhang, a perimeter of the third hole at the lower surface is smaller than the third lower-portion outer perimeter and larger than the third upper-portion outer perimeter, the third leg extends through the third hole, the third lower portion contacts the lower surface at the third interface, the third upper end is coupled to the first overhang, a perimeter of the fourth hole at the lower surface is smaller than the fourth lower-portion outer perimeter and larger than the fourth upper-portion outer perimeter, the fourth leg extends through the fourth hole, the fourth lower portion contacts the lower surface at the fourth interface, and the fourth upper end is coupled to the second overhang.

2. The item of furniture recited in claim 1, wherein:

a size of the first hole substantially prevents the first upper portion from moving relative to the first hole, and a size of the second hole substantially prevents the second upper portion from moving relative to the second hole.

3. The item of furniture recited in claim 1, wherein:

the first overhang comprises a negative space, and the first upper end extends into the negative space.

4. The item of furniture recited in claim 1, wherein the first upper end is coupled to the first overhang by an adhesive.

5. The item of furniture recited in claim 1, wherein the first upper portion and the first hole are substantially cylindrical.

6. The item of furniture recited in claim 5, wherein the first lower portion is substantially cylindrical.

7. The item of furniture recited in claim 1, wherein the first leg is a unitary piece.

8. The item of furniture recited in claim 1, wherein the working portion is a unitary piece.

9. The item of furniture recited in claim 8, wherein the unitary piece has a C-shape.

10. The item of furniture recited in claim 8, wherein the unitary piece comprises at least two sheets of wood veneer.

11. A chair, comprising:

a first leg having a first floor-contacting end and a first upper end, the first leg comprising:

a first lower portion extending between the first floor-contacting end and a first interface between the first floor-contacting end and the first upper end, the first lower portion having a first lower-portion outer perimeter at the first interface, and a first upper portion extending between the first interface and the first upper end, the first upper portion having a first upper-portion outer perimeter at the first interface, the first upper-portion outer perimeter being smaller than the first lower-portion outer perimeter;

a second leg having a second floor-contacting end and a second upper end, the second leg comprising:

a second lower portion extending between the second floor-contacting end and a second interface between the second floor-contacting end and the second upper end, the second lower portion having a second lower-portion outer perimeter at the second interface, a second upper portion extending between the second interface and the second upper end, the second upper portion having a second upper-portion outer perimeter at the second interface, the second upper-portion outer perimeter being smaller than the second lower-portion outer perimeter;

a third leg having a third floor-contacting end and a third upper end, the third leg comprising:

a third lower portion extending between the third floor-contacting end and a third interface between the third floor-contacting end and the third upper end, the third lower portion having a third lower-portion outer perimeter at the third interface, and a third upper portion extending between the third interface and the third upper end, the third upper portion having a third upper-portion outer perimeter at the third interface, the third upper-portion outer perimeter being smaller than the third lower-portion outer perimeter;

a fourth leg having a fourth floor-contacting end and a fourth upper end, the fourth leg comprising:

a fourth lower portion extending between the fourth floor-contacting end and a fourth interface between the fourth floor-contacting end and the fourth upper end, the fourth lower portion having a fourth lower-portion outer perimeter at the fourth interface, a fourth upper portion extending between the fourth interface and the fourth upper end, the fourth upper portion having a fourth upper-portion outer perimeter at the fourth interface, the fourth upper-portion outer perimeter being smaller than the fourth lower-portion outer perimeter;

a seat portion comprising:

a top having an upper surface and a lower surface, the top comprising a first hole, and a second hole, a third hole, and a fourth hole, each of the first, and second, third, and fourth holes extending between the lower surface and the upper surface, a first overhang, and a second overhang; and a back portion coupled to the first and second legs, wherein:

the back portion and the seat portion are separate components of the chair, a perimeter of the first hole at the lower surface is smaller than the first lower-portion outer perimeter and larger than the first upper-portion outer perimeter, the first leg extends through the first hole, the first lower portion contacts the lower surface at the first interface, the first upper end is coupled to the first overhang, a perimeter of the second hole at the lower surface is smaller than the second lower-portion outer perimeter and larger than the second upper-portion outer perimeter, the second leg extends through the second hole, the second lower portion contacts the lower surface at the second interface, the second upper end is coupled to the second overhang, a perimeter of the third hole at the lower surface is smaller than the third lower-portion outer perimeter and larger than the third upper-portion outer perimeter, the third leg extends through the third hole, the third lower portion contacts the lower surface at the third interface, the third upper end is coupled to the first overhang, a perimeter of the fourth hole at the lower surface is smaller than the fourth lower-portion outer perimeter and larger than the fourth upper-portion outer perimeter, the fourth leg extends through the fourth hole, the fourth lower portion contacts the lower surface at the fourth interface, and the fourth upper end is coupled to the second overhang.

12. The chair recited in claim 11, wherein the back portion is attached to the first and second legs by a mortise and tenon joint.

13. The chair recited in claim 12, wherein:

the back portion comprises first and second tenon tongues, the first leg comprises a first mortise hole in which the first tenon tongue is seated, and the second leg comprises a second mortise hole in which the second tenon tongue is seated.

14. The chair recited in claim 13, wherein the first mortise hole is in the first upper portion and the second mortise hole is in the second upper portion.

15. The chair recited in claim 11, wherein the back portion comprises a fifth hole and a sixth hole, and wherein:

the fifth hole is between the top and the first overhang, the first upper portion extends through the fifth hole, the sixth hole is between the top and the second overhang, and the second upper portion extends through the sixth hole.

16. The chair recited in claim 15, wherein an interior volume of the fifth hole and an interior volume of the sixth hole substantially prevent the back portion from moving relative to the first and second legs.

17. The chair recited in claim 11, wherein the back portion comprises at least two sheets of wood veneer.

18. The chair recited in claim 11, further comprising a seat cushion on top of at least a portion of the upper surface of the top, wherein the seat cushion is held in place by the first and second legs.

19. The chair recited in claim 11, wherein:

the back portion comprises first and second projections, the first projection is seated in the first leg, and the second projection is seated in the second leg.

20. The item of furniture recited in claim 1, wherein:

the first overhang comprises a threaded hole, the first upper portion comprises a thread proximate to the first upper end, and the thread is mated to the threaded hole.

* * * * *